US012631093B2

(12) United States Patent
Keyes et al.

(10) Patent No.: US 12,631,093 B2
(45) Date of Patent: May 19, 2026

(54) OVERMOLDED SHAPED CHARGE AND METHODS OF USE

(71) Applicant: Defiant Precision Technologies, LLC, Odessa, TX (US)

(72) Inventors: Cullen Craig Keyes, Hysham, MT (US); Ian Graham Janke, Parkland County (CA); Lawrence Gene Griffin, Morrison, CO (US)

(73) Assignee: Defiant Precision Technologies, LLC, Odessa, TX (US)

( * ) Notice: Subject to any disclaimer, the term of this patent is extended or adjusted under 35 U.S.C. 154(b) by 0 days.

(21) Appl. No.: 18/664,687

(22) Filed: May 15, 2024

(65) Prior Publication Data

US 2024/0384630 A1 Nov. 21, 2024

Related U.S. Application Data

(60) Provisional application No. 63/503,432, filed on May 19, 2023.

(51) Int. Cl.
*E21B 43/117* (2006.01)
*F42B 1/032* (2006.01)

(52) U.S. Cl.
CPC ..... *E21B 43/117* (2013.01); *F42B 1/032* (2013.01)

(58) Field of Classification Search
CPC ..... F42B 1/032; E21B 43/117
See application file for complete search history.

(56) References Cited

U.S. PATENT DOCUMENTS 5,046,428 A 9/1991 Jungblut et al.
6,499,406 B2 12/2002 Shim
7,124,688 B2 10/2006 Avetisian et al.
7,721,649 B2 5/2010 Hetz et al.
8,950,509 B2 2/2015 Coffey et al.
9,995,563 B2 6/2018 Redeker et al.
10,132,148 B2 * 11/2018 Moore ..... C06B 45/00
11,703,075 B1 * 7/2023 Blazek ..... F16B 37/08 411/436
11,913,766 B2 * 2/2024 Prisbell ..... E21B 43/119
12,209,849 B2 * 1/2025 Kash ..... E21B 43/1185
12,215,576 B2 * 2/2025 Preiss ..... E21B 43/11855
2012/0247771 A1 * 10/2012 Black ..... E21B 43/1185 166/55
2020/0199983 A1 * 6/2020 Preiss ..... F42D 1/02
2021/0340846 A1 11/2021 Daly
2022/0290960 A1 * 9/2022 Prisbell ..... F42D 1/02
2024/0247923 A1 * 7/2024 Prisbell ..... F42D 1/02
2024/0384630 A1 * 11/2024 Keyes ..... E21B 43/119
2024/0392662 A1 * 11/2024 Preiss ..... E21B 43/11855
2025/0043664 A1 * 2/2025 MacGillivray ..... E21B 43/1185

OTHER PUBLICATIONS

International Search Report and Written Opinion received for PCT Patent Application No. PCT/US2024/029651, mailed on May 9, 2025, 11 pages.

* cited by examiner

*Primary Examiner* — Michelle Clement
(74) *Attorney, Agent, or Firm* — Workman Nydegger

(57) ABSTRACT

One example apparatus includes a shaped charge, and an overmold that includes one or more layers surrounding a portion of the shaped charge. The overmold may contact, and conform to, a case within which the shaped charge is received, and the overmold may further contact, and conform to, a cartridge wall within which the shaped charge and the overmold are positioned. An electrical or electronic component may be partly embedded in the overmold.

20 Claims, 5 Drawing Sheets

OVERMOLDED SHAPED CHARGE AND METHODS OF USE

TECHNOLOGICAL FIELD OF THE DISCLOSURE

Embodiments disclosed herein generally relate to systems and equipment for use in downhole operations. One or more particular embodiments are directed to shaped charges, and methods for their use, in downhole operations such as, but not limited to, frac'ing.

BACKGROUND

Shaped charges are a type of explosive device that are used to penetrate hard materials by generally focusing an explosive force in a particular direction. The basic concept behind a shaped charge is relatively simple. Namely, an explosive material is shaped into a conical or cylindrical form, with a hollow cavity in the center. When the explosive is detonated, the resulting blast wave is focused by the shape of the device, creating a high-velocity jet of material that can penetrate a variety of materials.

While shaped charges have proven useful, conventional configurations and designs suffer from various shortcomings. For example, it has proven difficult to implement adequate confinement of the explosive effect of shaped charges. Thus, while the shaped charge may be aimed in a particular direction, unacceptable collateral damage may still result. As another example, conventional shaped charges are directly exposed to the environment in which they are employed and as such are vulnerable to damage that may compromise, if not prevent, operation of the shaped charge. Finally, some conventional shaped charges must be oversized to compensate for low explosive efficiency.

BRIEF DESCRIPTION OF THE DRAWINGS

In order to describe the manner in which at least some of the advantages and features of one or more embodiments may be obtained, a more particular description of embodiments will be rendered by reference to specific embodiments thereof which are illustrated in the appended drawings. Understanding that these drawings depict only typical embodiments and are not therefore to be considered to be limiting of the scope of this disclosure, embodiments will be described and explained with additional specificity and detail through the use of the accompanying drawings.

DETAILED DESCRIPTION OF ASPECTS OF SOME EXAMPLE EMBODIMENTS

Figure 1:
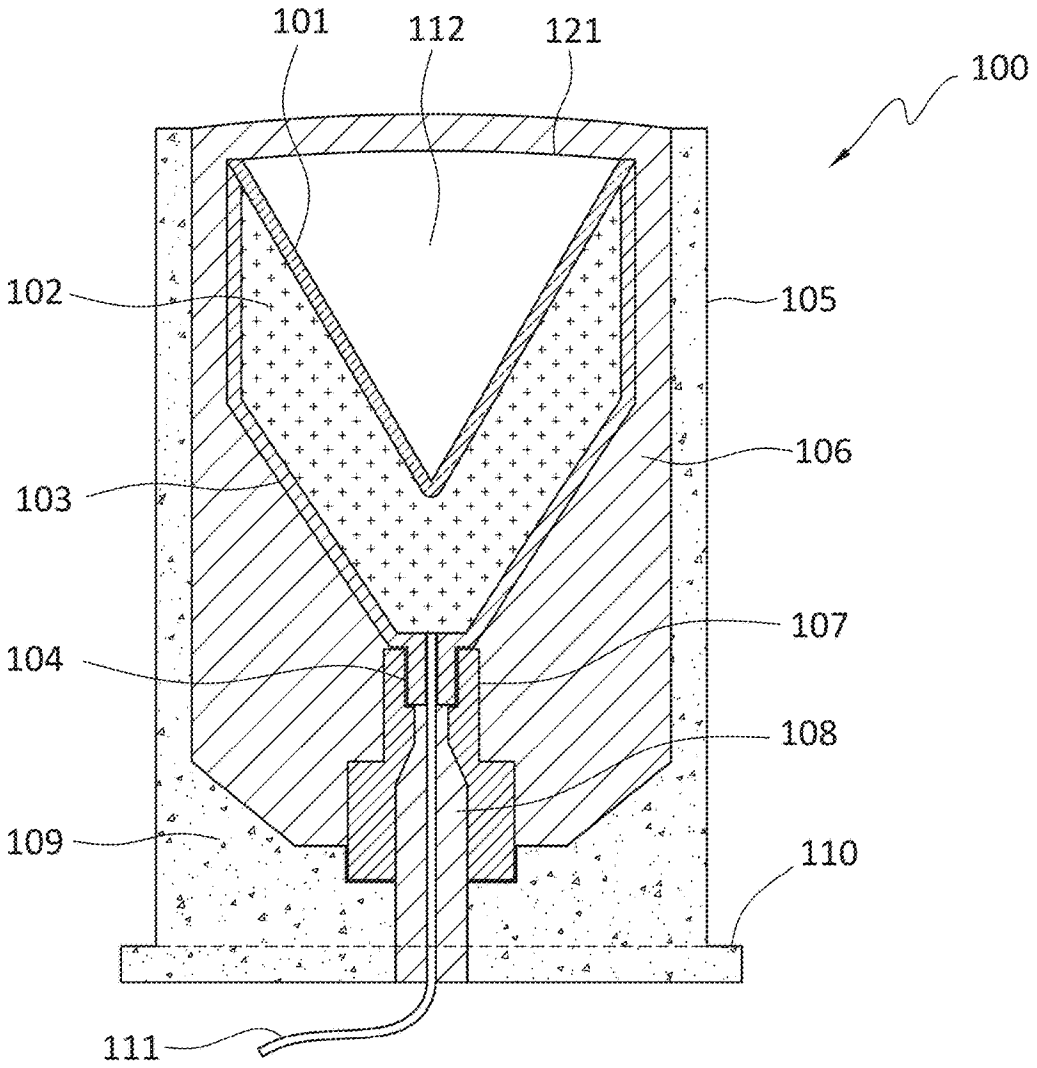
FIG. 1 discloses a cross section view of an overmolded shaped charge assembly including a cartridge, according to one embodiment.

Embodiments disclosed herein generally relate to systems and equipment for use in downhole operations. One or more particular embodiments are directed to shaped charges, and methods for their use, in downhole operations such as, but not limited to, frac'ing.

One example embodiment comprises a shaped charge that is overmolded in a material, such as plastic for example, and is encased by a cartridge that may be able to survive the blast of the shaped charge. In an embodiment, the cartridge may be configured as a sacrificial material to protect a barrel. In an embodiment, the cartridge may be configured to propel or fire the overmolded shaped charge.

Embodiments, such as the examples disclosed herein, may be beneficial in a variety of respects. For example, and as will be apparent from the present disclosure, one or more embodiments may provide one or more advantageous and unexpected effects, in any combination, some examples of which are set forth below. It should be noted that such effects are neither intended, nor should be construed, to limit the scope of the claims in any way. It should further be noted that nothing herein should be construed as constituting an essential or indispensable element of any embodiment. Rather, various aspects of the disclosed embodiments may be combined in a variety of ways so as to define yet further embodiments. For example, any element(s) of any embodiment may be combined with any element(s) of any other embodiment, to define still further embodiments. Such further embodiments are considered as being within the scope of this disclosure. As well, none of the embodiments embraced within the scope of this disclosure should be construed as resolving, or being limited to the resolution of, any particular problem(s). Nor should any such embodiments be construed to implement, or be limited to implementation of, any particular technical effect(s) or solution(s). Finally, it is not required that any embodiment implement any of the advantageous and unexpected effects disclosed herein.

A. CONTEXT FOR AN EMBODIMENT

Shaped charges date back to the early 19th century when early experiments with explosives began to reveal the potential of shaped charges for industrial applications. One of the earliest documented uses of a shaped charge was in 1883, when a French mining engineer named Henri M. Salleron used a conical shaped charge to bore a hole through a rock face. The success of this experiment led to further developments in shaped charge technology, as engineers and scientists began to explore the potential of this new type of explosive.

The use of shaped charges for oil and gas well perforation began in the 1940s, following their successful deployment in military applications during World War II. The first oil well perforating shaped charges design consisted of a cylindrical explosive charge surrounded by a metal casing. These early designs were only moderately effective, with the resulting perforations often irregular and inefficient. Developments in shaped charges continued in the 1950s and into the 1980s.

Modern shaped charges are widely used in the oil and gas industry to perforate casing and cement barriers in order to access and extract hydrocarbons from reservoirs. An important functions of these shaped charges is their ability to penetrate hard materials with relatively little collateral damage. Because the explosive force is focused in a specific direction, the damage to surrounding structures and materials is often minimal. This makes shaped charges ideal for use in situations where precision and control are critical.

Notwithstanding these advancements in shaped charge technology however, a variety of problems in this field remain unresolved. Examples of these problems are noted above.

B. SYSTEMS AND DEVICES RELATING TO AN EMBODIMENT

Typical components that make up the barrels, carriers, and shaped charges, used for oil and gas well perforation are configured to be used only once. This is due at least in part to the extreme pressures, temperatures, and stresses involved in a typical perforation process.

B.1 Shaped Charge Carrier

The shaped charge carrier is a hollow cylindrical tube that houses the shaped charge and provides a path for the explosive jet to penetrate the target formation. The carrier is typically made of a high-strength material, such as steel or copper, and is designed to withstand the high pressure and temperature conditions generated during the firing process. The carrier is usually equipped with a number of features designed to improve the performance and safety of the perforation operation. These features may include safety locks or mechanisms to prevent accidental firing, as well as alignment guides or markers to ensure accurate placement of the carrier and shaped charge. Once the shaped charges are fired, the carrier is destroyed and is not reusable.

B.2 Shaped Charge Barrel

The shaped charge barrel is a larger cylindrical tube that houses the shaped charge carrier and provides additional protection and support during the perforation operation. The barrel is typically made of a high-strength material, such as steel or aluminum, and is designed to withstand the extreme pressure and temperature conditions generated during the firing process. The barrel is usually equipped with a number of features designed to improve the performance and safety of the perforation operation. These features may include safety locks or mechanisms to prevent accidental firing, as well as alignment guides or markers to ensure accurate placement of the barrel and carrier. Once the shaped charges are fired, the barrel is destroyed and is not reusable.

B.3 Shaped Charge

The shaped charge is the explosive device at the heart of the perforation operation. The charge is typically made up of a cylindrical explosive charge surrounded by a metal liner, which is shaped into a conical or spherical form to create a focused jet of explosive energy. The explosive charge is usually made up of a high-energy material, such as RDX or HMX, which produces a large amount of pressure and heat when detonated. The liner is typically made of a high-strength material, such as copper or steel, and is designed to rapidly accelerate and shape the explosive energy into a focused jet.

The shaped charge is carefully assembled and tested to ensure maximum performance and safety during the perforation operation. However, due to the extreme pressure and temperature conditions generated during firing, the liner and other components of the shaped charge are typically deformed or damaged beyond repair, rendering the shaped charge unusable for future operations.

Shaped charges used for oil and gas well casing perforation may include several components, each designed to contribute to the overall performance of the device. The main components of a typical oil and gas well casing perforating shaped charge are:

1. Explosive Material: The explosive material is the heart of the shaped charge and is responsible for generating the high-pressure, high-velocity jet of material that penetrates the casing. The explosive material is typically composed of a mixture of explosives, such as RDX or HMX, and a fuel, such as aluminum powder or magnesium.
2. Liner: The liner is the component that shapes the explosive force and focuses it into a high-velocity jet. The liner is typically composed of a high-strength metal, such as copper or steel, and is shaped into a conical or hemispherical geometry. The shape and size of the liner are carefully designed to optimize the performance of the shaped charge for the specific application.
3. Detonator: The detonator is the component that initiates the explosive reaction in the shaped charge. The detonator is typically composed of a small explosive charge, such as PETN or HNS, and is connected to an electrical or mechanical trigger mechanism. The detonator is positioned at the base of the shaped charge and is designed to ensure that the explosive reaction occurs at the precise moment and location required.
4. Case: The case is the outer shell of the shaped charge and serves to contain the explosive material and protect the device during transport and handling. The case is typically composed of a high-strength metal, such as steel or aluminum, and is designed to withstand the high pressures and temperatures generated by the explosive reaction.
5. Boosters: Boosters are small explosive charges that are placed between the detonator and the main explosive charge. Boosters are designed to amplify the energy of the detonator and ensure that the explosive reaction propagates through the main explosive charge with maximum efficiency.
6. Tail Section: The tail section is the component that attaches the shaped charge to the perforating gun and positions it in the desired location in the wellbore. The tail section is typically composed of a high-strength metal, such as steel or aluminum, and is designed to withstand the forces generated during firing.

Shaped charge barrels are designed to be used only once in oil and gas perforating operations. This is due to the nature of the perforating process, which subjects the barrel and its associated components to high pressures, temperatures, and stresses that can cause irreversible damage.

During a perforating operation, the shaped charge is fired through the barrel and into the target formation, creating a perforation through the casing and cement barriers. This process generates a large amount of energy in a very short period of time, resulting in extreme pressure and temperature conditions within the barrel and surrounding environment.

The intense pressure and heat generated by the firing process can cause significant deformation and damage to the barrel, liner, detonation mechanism, carrier, and all existing components located inside the gun barrel. In particular, the liner of the shaped charge, which is designed to rapidly accelerate and shape the explosive energy into a focused jet, experiences significant stress and deformation during the firing process. This can cause the liner to crack, deform, or break, rendering the shaped charge ineffective for future perforation operations if a shaped charge next to that specific charge is fired. That explosion may cause irreversible damage to the neighboring shaped charges inside the gun barrel. Gun barrels are typically loaded with 3 or 6 shaped charges on a carrier. That specific system is designed so that all shaped charges inside that barrel are fired simultaneously at once. This is necessary due to the nature of the explosion that occurs inside the gun barrel.

Additionally, the high-pressure shock wave generated by the firing of the shaped charge can cause damage to the barrel and its associated components, including the detonation mechanism and any wiring or electronics used for remote triggering. This damage can result in safety hazards and malfunctions that render the barrel and shaped charge unusable for future operations.

As a result of these factors, shaped charge barrels are typically designed to be used only once and are discarded after each perforation operation. This allows for maximum safety and reliability during subsequent operations, as well as ensuring that the perforating equipment is always in optimal condition for use.

Conventional perforating gun strings that are used in oil and gas today, may consist of multiple gun barrels and each gun barrel may accommodate a carrier, and 3 to 6 shaped charges, and isolation bulkheads between each gun barrel. The isolation bulkhead is required to ensure that when one of the gun barrels shaped charges are fired, the next gun barrel is not flooded or destroyed by the explosion that ensues when the shaped charge is fired.

The concerns regarding shaped charge operations raised in the above discussion may be better appreciated with reference to an example use case for a conventional perforating system. In particular, a stage in a frac'ing operation may require a shaped charge perforating system. That specific stage may require 15-45 perforations be made in the casing and formation. If the stage requires 45 perforations and a non-reusable gun barrel is only to accommodate 6 shaped charges, the required amount of gun barrels would be 8. This would require a bulkhead between each gun barrel. This particular gun string may have a length of 25 to 50 feet. As this example illustrates, the unfired shaped charges in such a string may be vulnerable to damage, and thus rendered nonfunctional, due to their configuration and operation.

C. GENERAL ASPECTS OF AN EMBODIMENT

One example embodiment comprises a shaped charge that is overmolded in a material, such as plastic for example, and is encased by a cartridge. In an embodiment, an overmolded shaped charge may be used to perforate a casing and a geological formation, or simply 'formation,' of oil, gas, and geothermal wells. The overmolded shaped charge configuration may enable shaped charge designs to be more flexible at least with respect to their size and geometry.

An overmolded shaped charge according to one embodiment may possess various useful features and advantages relative to conventional systems, devices, and methods. However, no embodiment is required to possess any of such features and advantages. The following examples are illustrative, but not exhaustive.

In particular, the features and advantages of one or more embodiments may include the following, any one or more of which may be realized when performing operations including, but not limited to, perforating oil, gas, and geothermal, wellbores:

1. Overmolding of the shaped charge provides early containment of the explosive charge, and this containment may enhance or amplify the directional focus of the blast energy in the desired direction. By more completely focusing the energy, deeper penetrations in the casing and formation may be achieved with equal amounts of explosive when compared to conventional shaped charge form factors. Thus, use of an overmolded shaped charge according to one embodiment may achieve deeper penetrations, or the same depth of penetrations with smaller explosive loadings than are employed in conventional shaped charges.
2. Incorporating the overmolded shaped charges with a chamber/barrel, placed inside the barrel, may provide additional confinement of the explosive charge, further enhancing and amplifying, the directional focus of the blast energy in the desired direction.
3. Overmolding may provide for high-pressure sealing package of the shape-charge and ignition components, including wiring, thus improving reliability for the system. This sealing characteristic may enable the charge to be exposed, without material damage, to hostile environments including high-pressure, high-temperature, low-pressure, low-temperature, liquid, corrosive or gas. The over mold enables the shaped charge to be conveyed in an open chamber/barrel not sealed in a metal tube, therefore, the shaped charge can be placed near the edge of the case closer to the targeted casing wall and does not require shooting through the additional material such as, scallops or bands, as are employed in conventional approaches. That is, an overmolded shaped charge according to an embodiment may be placed in a gun that is configured such that the shaped charge is exposed to environmental conditions in a downhole location, for example. Such a gun may have various holes with which respective overmolded shaped charges are aligned, and/or alignable.
4. An overmolded shaped charge, that is sealed, may eliminate the need to have a bulkhead between each gun, therefore reducing the overall length of the perforating system and creating a more efficient operation.
5. The efficiency gained, such as reduced charge size for example, from the use of the overmold and placement of the shaped charge relatively nearer to outside of the case, may enable the incorporation of various geometry beyond circular holes including but not limited to elliptical, slotted, or wedge shapes. Such geometries may be employed with respect to any of a liner, a case, and a shaped charge.
6. The overmolding packaging may enable simpler, more reliable, and quicker, loading of a perforating gun through wire connections which, in turn, may significantly reduce the delivered cost for perforating.
7. The packaged overmolded charges may be utilized in a reloadable gun system, further reducing the delivered cost for the perforating system.
8. Overmolding allows for more flexibility in liner and case design and reduced or increased charge requirements. An example of enhanced flexibility in design is enabling customizable and uncharacteristic liner and case designs.

C.1 Perf Gun for an Overmolded Shaped Charge According to One Embodiment

An overmolded shaped charge, according to one embodiment, may be used in a conventional gun string which may include a carrier and a barrel. In one conventional gun string, scallops and/or bands are machined into the outer surface of the barrel. The overmolded shaped charge may be used in various types and configurations of perf guns including, but not limited to:

a. a conventional gun string that includes scallops and bands, or other sacrificial portions, machined into the barrel;

b. a conventional gun string that does not have bands or scallops; and c. a conventional gun string that does not have scallops or bands, but includes holes that may form a ported, or open, pathway for the projectile to travel through when the gun is fired—this gun string may comprise a wet gun string, meaning that water, wellbore pressure, and contaminant(s) may enter the gun barrel prior to, during, and/or after, the gun has been fired.

An overmolded shaped charge according to one embodiment may be used in an interlocking perforating gun. The overmolded shaped charge, and its cartridge that contains it, may be loaded into a barrel, or a receiver of an interlocking perforating gun body. One example configuration is disclosed in FIGS. 2 and 3, and discussed in more detail below.

Another benefit, relative to conventional charges and guns, of the overmolded shaped charge, for use in oil, gas, and geothermal applications, is the ability to fire one overmolded shaped charge at a time without damaging the gun, other components located in the gun, or other shaped charges located in the gun. Conventional perforating systems require that all shaped charges located in a given barrel be fired at once. An overmolded shaped charge according to one embodiment may eliminate the need to fire multiple overmolded shaped charges simultaneously. Thus, the overmolded shaped charge in this example embodiment may enable a process in which multiple overmolded shaped charges are fired in some specified sequence.

C.2 Example Manufacturing Processes for Overmolded Shaped Charges

In an embodiment, an overmolding process comprises a process in which a material is molded onto an existing component or substrate. The existing component, in one or more embodiments, is the shaped charge, and may also comprise other devices that may be included to enhance the performance of the shaped charge.

In an embodiment, an overmolding process may be used to add features, improve functionality, or enhance aesthetics of the shaped charge. Overmolding may be performed using a variety of materials including, but not limited to, thermoplastic elastomers (TPE), thermoplastic polyurethane (TPU), silicone, and other elastomers. Following is a discussion of one example process and procedure, according to an embodiment, for overmolding a shaped charge from manufacturing fixtures, molds, pouring or injecting the over mold material, and finishing the product. Note that as used herein, an 'overmold' and 'overmolding' process are not intended to be limited for use with any particular overmold material(s).

C.2.1 Design and Preparation of a Component to be Overmolded

In one embodiment, the first step in overmolding is designing and preparing the component to be overmolded, such as a shaped charge for example. This may involve, for example, selecting the materials, shapes and geometries, as well as sizes of the shaped charge to fit into the mold where the overmolding will be performed. The shaped charge may be configured with the correct dimensions and tolerances to ensure a good fit in the mold. The shaped charge may also be cleaned and prepared for overmolding. The surface of the shaped charge may be free of any contaminants such as oil or dust. The shaped charge may be overmolded with, or without, the shaped charge loaded between the liner and the case.

C.2.2 Design and Fabrication of the Mold

In one embodiment, the second step of an example overmolding process comprises designing and fabricating the mold in which the component will be placed for overmolding. The mold may be configured to accommodate the shaped charge and the overmolding material. The mold may be made from a durable material such as steel or aluminum. The mold may also comprise features such as ejector pins and venting to ensure proper molding, and removal of the overmolded item from the mold.

C.2.3 Manufacturing Fixtures

In one embodiment, after the mold is designed and fabricated, the manufacturing fixtures may be produced to support the mold in the manufacturing process. Fixtures may be used to hold the mold in place during the overmolding process. The fixtures may be configured to ensure that the mold is held securely in place during the injection process.

C.2.4 Overmolding Material(s) Selection

In one embodiment, the overmolding material may be selected based on the shaped charge properties and requirements. The overmolding material may be chosen based on its hardness, flexibility, and chemical resistance. The overmolding material may be compatible with the substrate material, that is, the material that will be contacted by the overmolding material, to ensure a strong bond between the two materials.

C.2.5 Example Molding Process—Injection Molding Process

In one embodiment, the overmolding process may comprise injecting the overmolding material into the mold cavity where the object, such as a shaped charge, may be located. In one embodiment, the injection molding process may comprise several operations including, but not limited to:

1. melting the overmolding material—the overmolding material may be melted in a barrel or other container using heat and pressure;
2. injecting the material into the mold—once the overmolding material is melted, it is injected into the mold cavity under pressure;
3. cooling the mold—after the overmolding material is injected into the mold, the mold is cooled to solidify the overmolding material; and
4. ejecting the molded product—after the overmolded material is solidified, the overmolded item is ejected from the mold.

C.2.6 Finishing the Product

In one embodiment, the final step in an overmolding process comprises finishing the product. Finishing may involve, for example, removing any excess material, such as flash, from the now overmolded shaped charge and ensuring that the overmolded shaped charge meets the required specifications. The finishing process may include trimming, sanding, or polishing the overmold portion of the overmolded shaped charge C.2.7 Overmolding Process Variations In other example embodiments, variations of an overmolding process may be employed, including insert molding and two-shot molding. Some example processes are discussed below.

C.2.7.1 Insert Molding

Insert molding is a process in which a component or substrate, such as a shaped charge for example, is placed into the mold before the overmolding material is injected. The existing component, in this case, is the shaped charge and other devices that may be included to enhance the performance of the shaped charge. The overmolding material is then injected or otherwise introduced into the mold, bonding with the shaped charge material to create a single, overmolded, component.

In one embodiment, an insert molding process may comprise the following operations:

1. design and preparation of the shaped charge—the shaped charge is designed and prepared for the insert molding process;
2. design and fabrication of the mold—the mold is designed and fabricated to accommodate the shaped charge and the plastic material that will be used for overmolding—in an embodiment, the mold may comprise a cavity to receive the shaped charge, and channels through which the plastic material can flow into the cavity;
3. insertion of the shaped charge—the shaped charge is inserted into the mold, and may be held in place with pins or other features that prevent it from shifting during the molding process;
4. injection of the plastic, or other suitable, material—the plastic material is injected into the mold so as to overmold, partially or completely, the shaped charge, and create a single component; and
5. cooling and ejection—after the overmolding material is injected into the mold, the mold is cooled to solidify the materials. The finished overmolded shaped charge is then ejected from the mold.

C.2.7.2 Two-Shot Molding

In an embodiment, two-shot molding is a process in which two different materials are injected into a mold to create a single component that includes an overmold comprising the two different materials. In one embodiment, a first material is injected into the mold to create a first overmold as the substrate or base component for a subsequent overmold. The second material is then injected into the mold to overmold the first overmold, creating a single component with two different materials, one of which is overmolded over the other so that at least a portion of the overmold comprises two layers. This process may include techniques from both processes, insert molding and two-shot molding.

Thus, in an embodiment, a component such as a shaped charge may be inserted into a mold. The first material may be injected into the mold and bonded to the shaped charge. The second material may then be injected into the mold and bonded to the first injected material. This may be done to enable inclusion of other components such as fuses, electrical devices and mechanisms, nanotechnology, tracers, combustible materials, and other materials, devices, and mechanisms that may be used to enhance the performance of the shaped charge, gather and record data, or increase reliability, efficiency, and durability of the overall component. In particular, such components may reside on or near the first material so that they are covered or enclosed/encased in part, or entirely, by the second shot of material.

In one embodiment, a two-shot molding process comprises the following operations:

1. injection of the first material—the first material is injected into the mold to create the substrate or base component that is covering a certain part of the shaped charge, other device, or the entire shaped charge;
2. transfer of the substrate to the second mold—the substrate is transferred to a second mold for overmolding;
3. injection of the second material—the second material is injected into the second mold, overmolding the first material and creating a single component with two different layers of materials now covering part, or all, of the shaped charge; and
4. cooling and ejection—after the overmolding material is injected into the second mold, the mold is cooled to solidify the materials—the finished overmolded shaped charge is then ejected from the second mold.

C.2.7.3 Other Example Processes that May be Used in an Embodiment

Other overmolding processes that may be employed in an embodiment for overmolding a shaped charge may include, but are not limited to:

1. Multi-Shot molding: multi-shot molding is a process in which two or more different materials are injected, possibly at different respective times, into the mold to create a single component in a single cycle. This process can be used to create complex components with multiple materials.
2. In-Mold Decorating (IMD): In-mold decorating is a process in which a decorative film or label is placed inside the mold before injection molding. The plastic material is then injected over the film or label, fusing the film or label to the component and creating a finished product with a decorated surface.
3. In-Mold Assembly (IMA): In-mold assembly is a process in which multiple components are placed inside the mold before injection molding. The plastic material is then injected over the components, fusing them together and creating a finished product with assembled parts.
4. Co-Injection Molding: Co-injection molding is a process in which two different materials are injected simultaneously into the mold, creating a single component with a skin and a core. The skin material can provide a cosmetic surface, while the core material provides strength and rigidity.
5. Hybrid Overmolding: Hybrid overmolding is a process in which multiple overmolding processes are combined to create a single component that includes multiple materials. For example, a component can be insert molded with a metal insert and then two-shot molded with a plastic over mold.

C.2.8 Advantages of Overmolding

The use of an overmolding process, and overmold, in one or more embodiments may present various advantages. Some examples of such advantages are discussed below. In an embodiment, some advantages of overmolding may include, but are not limited to:

1. Enhanced functionality: Overmolding may add features and functionality to a product, such as a shaped charge. For example, overmolding can be used to increase the directional focus of the explosion towards the target 120.
2. Improved aesthetics: Overmolding may be used to improve the appearance of a product. The overmolding material can be colored or textured to create a unique look.
3. Improved durability: Overmolding may improve the durability of a product. The overmolding material may act as a protective layer that is resistant to abrasion such as sand and debris in the wellbore, chemicals such as friction reducer and acid, and UV light. This durability enhancement may also protect the shaped charge from damage downhole and enable the shaped charge to be exposed to the wellbore before it is fired. For example, a shaped charge, protected by an overmold, may be exposed to the wellbore all of the time, thereby eliminating the need to use a protective gun barrel, or tube, to cover the shaped charge prior to firing. This enhancement may enable the shaped charge to be exposed to pressures up to 20,000 psi without materially affecting the operation of the shaped charge.

4. Reduced assembly time: Overmolding may reduce assembly time and costs by creating a single component with multiple materials and devices, where the devices may be partly or completely embedded or encased in one or more molded layers of the overmolded shaped charge.
5. Increased design flexibility: Overmolding provides increased design flexibility. Multiple materials can be used to create complex geometries and shapes. This may significantly enhance the functionality and performance of the shaped charge. This enables flexibility for the shaped charge to have multiple shapes such as elliptical shapes, perfect circles/spheres, diamond shapes, rectangular, square, hexagonal and octagonal, as well as triangular.

C.2.8.1 Example Overmold Materials

In an embodiment, one or more materials may be used to overmold a component such as a shaped charge. The materials may form discrete overmold layers that are layered one over the other, or the materials may be partly or completely blended together before, and/or during, an overmolding process. An embodiment may comprise a first overmold layer made of a first material, and a second overmold layer layered over the first overmold layer and comprising a second material that is the same as, or different from, the first material. Some example materials that may be employed when overmolding a shaped charge include, but are not limited to: Liquid Crystal Polymer (LCP); Polyetherimide (PEI); Polyphenylene Sulfide (PPS); Polyetheretherketone (PEEK); Polyimide (PI); Thermoplastic Polyurethane (TPU); Polysulfone (PSU); Liquid Silicone Rubber (LSR); Polyamideimide (PAI); Polyarylsulfone (PAS); Polyetherketone (PEK); Polybenzimidazole (PBI); Polyamide (PA); Acetal (POM); and Polycarbonate (PC).

Example combustible materials that may be employed when overmolding a shaped charge include, but are not limited to:

1. Polyethylene (PE): Polyethylene is a commonly used plastic material with good electrical properties and low moisture absorption, has a low melting point, and may be highly flammable. PE has various desirable properties including: high dielectric strength, indicating an ability to withstand high electric field intensities without breaking down; low dielectric constant, indicating an ability to store electrical energy in an electric field; high insulation resistance, indicating its ability to provide excellent electrical insulation and prevent leakage of current; low power loss—minimizes energy dissipation and improves the overall efficiency of electrical systems; high volume resistivity, which is the measure of resistance to the flow of electric current—this property enables polyethylene to effectively resist the flow of current and maintain its insulating properties over a wide range of environmental conditions; low dissipation factor, indicating that PE has low energy losses when subjected to an alternating current (AC); good thermal stability, enabling PE to withstand elevated temperatures without significant degradation of its electrical properties; highly resistant to moisture absorption, which helps PE maintain its electrical properties even in humid conditions; excellent resistance to a wide range of chemicals, including acids, bases, and organic solvents; and, flexibility, which enables easy installation and bending in electrical applications-PE flexibility facilitates the handling and routing of cables, making it a preferred choice for cable and wire insulation.
2. Polypropylene (PP): polypropylene is a thermoplastic material with high strength and stiffness, good chemical resistance, and low density and is also highly flammable;
3. Polystyrene (PS): polystyrene is a rigid, brittle plastic material that is highly flammable and may be suitable for certain overmolding applications; and
4. Polyvinyl Chloride (PVC): polyvinyl chloride is a material with good chemical resistance and is also highly flammable and may be suitable for certain overmolding applications.

D. DETAILED DISCUSSION OF ASPECTS OF AN EXAMPLE EMBODIMENT

Following is a discussion of one or more example embodiments disclosed in the figures. These embodiments, and this discussion, are presented only by way of example, and are not intended to limit the scope of the invention in any way.

With reference first to FIGS. 1-5, there are disclosed various embodiments 100 and 150, of an overmolded shaped charge assembly, and example components that may be included in the overmolded shaped charge assemblies 100 and 150. The examples of FIGS. 1-5 are provided by way of illustration and are not intended to limit the scope of this disclosure. More particularly, FIG. 4 discloses another shaped charge assembly 150. Except as shown in the Figures and/or as discussed below, the shaped charge assemblies 100 and 150 may be similar or identical in their configuration and/or operation. As will be apparent from this disclosure, a shaped charge assembly may be similar to a cartridge such as may be loaded into a gun for firing.

D.1 Liner

For example, the overmolded shaped charge 100 may comprise a liner 101. In one embodiment, the liner 101 is located above a shaped charge 102 and, depending on the material choice for the liner 101, the liner 101 may be pressed, welded, fused, or pressed into the case 103 that contains the shaped charge 102.

One purpose of the liner 101 is to form and direct the high explosive energy of the shaped charge 102 into a focused, high-velocity metal jet. The liner 101 is configured and arranged to collapse inward under the detonation pressure of the explosive, or charge. As the liner 101 collapses, it forms a high-velocity jet of metal that penetrates the target 120 material. In more detail, an embodiment comprises a single jet. The liner forms the cone geometry and as the shaped charge 102 is fired, the liner 101 will melt and turn into a plasma in the form of a metal jet.

The shape of the liner 101 may vary from a simple conical shape to more complex shapes such as, but not limited to, an ellipse, ogive, bi-conical, double cone, trumpet, or hyperbolic shape. The shape of the liner 101 may also determine the jet velocity and penetration depth. For example, a cone-shaped liner 101 according to one embodiment may produce a more focused jet with higher velocity and deeper penetration, while an ogive-shaped liner 101, for example, produces a wider, less focused jet with lower velocity and shallower penetration.

The liner 101 performance may depend on its material properties, thickness, shape, and velocity. The liner 101 material may have a high density and strength to withstand the detonation pressure and to promote uniformity in its inward collapse. The thickness of the liner 101 determines the jet velocity and penetration depth. In general, thicker liners 101 may create slower jets but deeper penetration, while relatively thinner liners 101 create faster jets but shallower penetration.

Different liner 101 geometries for a shaped charge 102 may provide benefits such as improved penetration, increased cutting ability, and reduced collateral damage. The shape and size of the hole, or perforation, created by the shaped charge 102 may also be influenced by the liner 101 geometry, with certain designs producing specific types of holes that may be desired for certain applications. Additionally, different liner 101 geometries can affect the formation and behavior of the jet that is created upon detonation, which can impact the overall performance and effectiveness of the shaped charge 102.

D.1.1 Liner Production Methods

There are several different methods that may be used to manufacture liners 101 for shaped charges 102. The choice of method may depend, for example, on the liner 101 material, its properties, and the desired liner 101 shape. Following are some example methods that may be used to manufacture liners 101 for shaped charges 102.

a. Machining—machining is a process of shaping the liner by cutting the material with a tool-machining is a precise and accurate method that can be used to create complex shapes and contours, and is commonly used to manufacture copper liners, which can be easily machined due to their ductility;
b. Extrusion—extrusion is a process of forcing a metal billet through a die to create a specific cross-sectional shape;
c. Drawing—drawing is a process of shaping a liner by pulling it through a die;
d. Powder metallurgy—powder metallurgy (PM) is a process of compacting metal powders under high pressure to create a dense, solid object-PM is a versatile method that may be used to produce liners with complex shapes and internal cavities;
e. Electroforming—electroforming is a process of creating a metal layer on a substrate by electrolysis, and may be used to create complex shapes and microstructures; and
f. Additive manufacturing/3D printing:
   i. Powder bed fusion—a process that involves using a laser or electron beam to melt and fuse copper powder together layer by layer to create the desired shape;
   ii. Binder jetting—in this process, a liquid binder is used to bind together layers of copper powder to create the desired shape—the resulting part is then sintered in a furnace to fuse the powder particles together; and
   iii. Directed energy deposition—this process involves using a high-energy heat source, such as a laser, to melt and deposit copper wire or powder onto a substrate to build up the desired shape.

D.1.2 Example Liner Materials

A liner 101 according to an embodiment may comprise various materials. Some examples of such materials are discussed below.

Example liner materials include, but are not limited to:

a. Copper—copper liners are ductile and have excellent thermal and electrical conductivity. They can be easily formed into different shapes, making them ideal for creating the desired jet profile. Copper liners are known for their high penetration capabilities and can achieve high velocities and depths of penetration.
b. Tungsten—tungsten liners are known for their high density and hardness. They have good thermal stability and can withstand high temperatures without degrading. Tungsten liners are also resistant to corrosion, making them suitable for use in harsh environments.
c. Steel—steel liners are known for their high strength and ability to withstand high pressures and are suitable for low-velocity applications.
d. Aluminum—aluminum liners are lightweight and have good thermal conductivity and can achieve high velocities. They can be easily machined to create complex shapes, and their low density allows for increased penetration depths.
4. Composite materials-composite liners are made up of different materials such as metals, ceramics, and polymers. They offer a combination of properties such as high strength, toughness, and thermal stability. Composite liners can be tailored to meet specific performance requirements.

D.2 Shaped Charge

In the example of FIGS. 1-5, the shaped charge 102 is located between the liner 101 and the case 103. The shaped charge 102 is the explosive that, when ignited, assists in collapsing the liner 101 and turning the liner 101 into a jet of molten metal. The shaped charge 102 may be in a powder form or liquid form, and may be ignited by a detonator, resistor, bridge wire, or other ignition and detonation devices, such as a primer. When the shaped charge 102 is ignited, it burns and expands rapidly towards the liner 101, causing the liner 101 to form into a jet of molten metal.

A shaped charge 102 according to one embodiment may comprise various materials. Some examples of such material include, but are not limited the following.

RDX/TNT: RDX (cyclotrimethylene trinitramine) is a powerful, high-velocity explosive, while TNT (trinitrotoluene) is a more stable explosive with a lower velocity. The combination of RDX and TNT can provide high penetration and fragmentation capabilities.

HMX: HMX (cyclotetramethylene tetranitramine) is a high-performance explosive that has a higher detonation velocity and energy than RDX/TNT.

Composition B: Composition B is a mixture of RDX and TNT with a binding agent such as wax or plasticizer.

PBX: PBX (Plastic Bonded Explosives) is a type of explosive made up of a mixture of high explosives and plastic binder. The plastic binder enhances the mechanical properties of the explosive and makes it easier to handle and mold.

Octol: Octol is a mixture of HMX and TNT and is a high-performance explosive. It has high detonation velocity, energy, and excellent thermal stability.

Various methods may be used to load a shaped charge 102 into a shaped charge assembly 100. For example, the shaped charge 102 may be loaded into the shaped charge assembly 100 from the rear through the cartridge base 109, an embodiment of which is discussed below. In an embodiment, this loading process may comprise pouring of a powder, crystalline, or liquid form, of charge material(s) into the case 103 with the liner 101 acting as the seal. The charge materials, which becomes the shaped charge 102, may be poured through the area where the detonator stem 108 resides. The pour may be done before installing the detonator 104 and detonator stem 108 in the shaped charge assembly 100. This process may be performed when the liner is already seated into the case and the shaped charge 102 is already overmolded, or not overmolded, depending on the embodiment.

In another loading method, the charge may be introduced from a top of the cartridge wall 105 before the liner 101 is seated to the case 103. In an embodiment, this loading process may be performed as part of an overmolding process such as hybrid overmolding. In a hybrid overmolding process, the charge, which may comprise powder, may be poured into the case 103, and the liner 101 pressed and seated to the case 103, a burst disk may be installed, and then the shaped charge 102, cooperatively formed by the liner 101 and case 103, overmolded. When performing a hybrid overmold process according to one embodiment, the shaped charge 102 may be overmolded up to the top of the case 103, the charge then poured in, the liner 101 pressed and seated to the case 103, a burst disk installed, and then the rest of the shaped charge 102 overmolded to the top.

D.3 Case

With continued reference to the example of FIGS. 1-5, the case 103 contains the shaped charge 102 and may be mounted to a bulkhead or other structure, for example. The case 103 may contain the charge 102 and the liner 101. In the example of an overmolded shaped charge 100, the case 103 may be configured such that, in one embodiment, the energy of the charge explosion is directed primarily in one direction.

D.3.1 Example Case Features and Functions

The case 103, according to one embodiment, may have various features and serve several purposes. For example, the case 103 case contains the explosive shaped charge 102 and directs the energy of the explosion of the shaped charge 102 towards the liner 101.

As another example, the geometry of the case 103 may define, or help to define, the shape of a jet. In particular, the case 103 may comprise a specific shape. From a top down view, the shape of the overmolded shaped charge 100, including the case 103, may be elliptical, triangular, perfect circle, square, and/or rectangular, for example. The shape of the jet may match the shape of the case 103. The shape of the case 103 may also control the direction and velocity of the metal jet as it penetrates the target 120.

An embodiment of the case 103 may also implement a containment function. For example, the shaped charge 102 may be highly sensitive such that it can be easily detonated by shock, heat, or friction. The case 103 may provide a protective barrier around the shaped charge 102, which helps to prevent accidental detonation and also ensures that the explosive energy of the shaped charge 102 is directed towards the target 120. As well, the case 103 may provide a stable platform for the shaped charge 102 to be mounted on, and may also help to maintain the integrity of the shaped charge 102 during transportation and storage. Further, the case 103 may help to align the shaped charge 102 with the target 120 and also ensures that the shaped charge 102 is oriented in the correct position for maximum effectiveness. In one embodiment, the case 103 may comprise fins or other features that help to stabilize the shaped charge 102 in flight and also ensure that the jet is directed towards the target 120.

In an embodiment, the case 103 may be configured to be compatible with different launch systems. These launch systems may include, but are not limited to, downhole perforation systems.

D.3.2 Example Production Processes for an Embodiment of a Case

An embodiment of the case 103 may be manufactured using a variety of different processes. One of these processes is metal casting, which may involve melting the metal and then pouring the molten metal into a mold that has the desired shape. Once the metal has cooled and solidified, the mold is removed, and the case 103 may be finished through additional machining and polishing processes.

A metal spinning process may be used to produce a case 103. Metal spinning is a process that involves rotating a metal disc on a lathe and shaping the rotating metal disc using specialized tools. This process may be used to make lightweight, high-strength shaped charge cases 103 from materials such as aluminum, for example.

An embodiment of a case 103 may be produced using an injection molding process to make a plastic case 103. An example injection molding process involves melting plastic pellets and injecting them into a mold that has the desired shape of the case 103. Once the plastic has cooled and solidified, the mold is removed, and the case 103 may be finished through additional polishing, trimming, and/or painting, processes.

A composite layup process may be used to produce an embodiment of a case 103. Such a process may be used to make a case 103 from composite materials such as fiberglass or carbon fiber. One example of this process involves layering sheets of composite material over a mold that has the desired shape of the case 103, and then using heat and pressure to bond the layers together. Once the composite material has cured, the mold is removed, and the case 103 may be finished through additional machining and polishing processes.

In an embodiment, machining processes may be used to produce a case 103. Such machining processes may involve the removal of material from a block or sheet of metal or composite material to create a case 103 with a desired shape and size.

As a final example, an additive manufacturing process may be use to produce an embodiment of a case 103. For example, 3D printing metal, also known as metal additive manufacturing, is a process that uses various technologies to create three-dimensional metal parts or objects from a digital model. This 3D printing process comprises layer-by-layer deposition of metal powder or wire using techniques such as selective laser melting (SLM), electron beam melting (EBM), or binder jetting. This process enables production of complex geometries, customization, and reduced waste compared to conventional metal manufacturing methods.

D.3.3 Example Materials for an Embodiment of a Case

A variety of different materials may be used to produce a case 103 according to one embodiment. One of such materials is steel, which has high strength, durability, and resistance to high temperatures. Steel cases 103 can be made to withstand the intense pressure and heat generated by the shaped charge 102. Another example case 103 material is aluminum, which is a lightweight material and is not as strong as steel, but is still able to withstand the pressure and heat generated by the explosive charge. An embodiment of a case 103 may be made of plastic, or of composite materials such as fiberglass or carbon fiber. These composite materials may be used to make cases that are both lightweight and strong. In an embodiment, a case 103 may be made of ceramic materials, such as boron carbide or aluminum oxide. A case 103 of one or more of these materials may be highly resistant to heat and abrasion. In an embodiment, a case 103 may be made of brass. Still another embodiment of a case 103 may be made of nickel-based alloys, such as the alloys respectively sold under the marks Inconel® and Monel®, which offer good strength and toughness at high temperatures and under extreme conditions. An embodiment of a case 103 may be made of titanium, which is lightweight, strong, and has good corrosion resistance. As a final example, a case 103 may be made of various alloys containing molybdenum and vanadium, which are often added to alloy steels to improve their properties, such as strength, toughness, and wear resistance.

D.4 Detonator

In an embodiment, the detonator 104, an example of which is disclosed in FIGS. 1-5, is located at the base of the case 103. In an embodiment, the detonator 104 may be encapsulated in whole or in part by the detonator stem 108, an embodiment of which is discussed below.

Among other things, the detonator 104 serves to initiate the explosive reaction of the shaped charge 102 and create the high-velocity jet of molten metal. The detonator 104 may be, for example, a small, high-explosive charge that detonates with high speed and accuracy when activated. The detonator 104 may comprise an electrical detonator, bridge wire, primer, resistor, or any detonation device capable of igniting the selected shaped charge 102.

When the detonator 104 is triggered, it transmits a shockwave that travels through the charge 102. This shockwave compresses and heats the explosive material of the shaped charge 102, causing the shaped charge 102 to rapidly explode and release a large amount of energy in the form of heat and one or more gases. As the shaped charge 102 explodes, it creates a high-pressure wave that travels toward the base of the shaped charge 102. This pressure wave causes the liner 101 to collapse inward and form a highly focused jet of molten metal that travels at high speed toward the target 120.

In an embodiment, the detonator 104 may be activated by an electrical signal, which is transmitted through a wire or other conductor that is connected to the detonator 104. The electrical signal may also be generated by a variety of sources, including a timer, a remote-control device, or a sensor that detects the presence of a target 120.

D.5 Cartridge Wall

In an embodiment, and with reference to FIGS. 1-5, the cartridge wall 105 contains the, overmolded, shaped charge 102 and acts as a secondary barrel for the shaped charge 102. The cartridge wall 105 may have a cylindrical, or annular, configuration and serve as the container for the shaped charge 102 and its additional components and other devices. The cartridge wall 105 may be pressed, or crimped into the material of the overmold 106 to hold and contain the overmold 106. The cartridge including the cartridge wall 105 may also be in place during the overmolding process and be incorporated into the overmold 106 itself. This process may be performed using hybrid overmolding or simple injection molding.

In an embodiment, the cartridge wall 105 may also act as a secondary barrel. In its role as a secondary barrel, the cartridge wall 105 material may be sacrificial, or may survive the charge 102 detonation without material damage. Overall, the cartridge wall 105 may be configured to increase the performance of the shaped charge 102 by having the plastic overmold 106 material contained as a buffer between the cartridge wall 105 and the case 103 during the explosion that is generated when the shaped charge 102 is ignited. Depending on the design and material, the cartridge wall 105 may survive the blast, such that the cartridge may be reusable, or able to have another shaped charge 102 overmolded into it.

In another embodiment, the cartridge wall 105 may comprise a sacrificial element that acts as a buffer and increase the performance of the shaped charge 102 by absorbing the energy of the blast and creating a more focused jet and explosion. The cartridge wall 105, based on the material selection and the overmold 106 thickness and material, may not survive the blast, but may absorb enough of the explosion and energy that the barrel of the system firing it, survives and is not damaged in any material way.

In one embodiment, the cartridge wall 105 may be omitted, and the overmolded shaped charge 102 may be inserted directly into a barrel of a perf gun, such as an interlocking perf gun for example. However, no particular type of perf gun is necessarily required in any embodiment.

D.5.1 Example Materials for a Cartridge Wall

A variety of different materials may be used for various embodiments of a cartridge wall 105. For example, various types of brass materials may be used for a cartridge wall 105, an example brass materials include, but are not limited to, alpha brass, beta brass, cartridge brass, naval brass, red brass, yellow brass, and dezincification-resistant brass. An embodiment of a cartridge wall 105 may comprise various aluminum materials such as, but not limited to, 1xxx Series, 2xxx Series (2024 aluminum for example), 3xxx Series (3003 aluminum for example), 4xxx Series (4043 aluminum for example), 5xxx Series (5052 aluminum for example), 6xxx Series (6061 aluminum for example), and 7xxx Series (7075 aluminum for example). Other example materials for an embodiment of a cartridge wall 105 include, but are not limited to, magnesium alloys, titanium alloys, nickel alloys, copper alloys including CuZn37 and CuZn36Mn2Al2Fe1-C, high-strength low-alloy (HSLA) steels, armor grade steels including steels conforming to MIL-A-46100 and MIL-A-12560, stainless steels including 17-4 PH and 15-5 PH, and tool steels including H13 and D2.

D.6 Overmold

An overmold 106 according to one embodiment is disclosed in FIGS. 1-5. The material of the overmold 106 may comprise a sacrificial material that is injected or poured, or otherwise introduced, into a mold that encapsulates the shaped charge 102 and other devices. By overmolding the shaped charge 102 in a plastic material, the energy of shaped charge 102 may be absorbed, and/or contained, by the plastic overmold 106 material as it slowly deforms during the explosion. The slow deformation and destruction of the overmold 106 enhances the performance of the shaped charge 102 by focusing and directing the energy of the jet resulting from decomposition of the shaped charge 102 and/or the liner 101.

In an embodiment, the overmold 106 may provide one or more benefits with regard to the configuration and/or operation of the shaped charge 102. For example, the size and geometry of the overmold 106 may increase the efficiency of the formation of the jet, by ensuring a consistent stand-off distance between the charge 102 and a target 120, and alignment of the shaped charge 102 with the target 120.

As another example, the size and geometry of an embodiment of the overmold 106 may contain the energy created by the explosion of the charge 102. This containment may in turn increase the efficiency, consistency, and the performance of the jet by partly containing or confining the energy of the jet in such a way that the energy may be focused and directed.

An embodiment of the overmold 106 may enable significant flexibility in the design and/or use of an embodiment of the shaped charge 102, as noted in the following examples. An embodiment of the overmold 106 may eliminate the need for a gun tube with scallops, bands, and may eliminate the need to shoot through an alloy gun tube before contacting the target 120. In an embodiment, an overmolded shaped charge 102 may not need to be housed inside of a gun tube for use. Rather, the overmolded shaped charge 102 may be assembled and aligned with barrels in an interlocking perforating gun, or may be used in a gun tube that may have the ability to chamber the cartridge of the shaped charge 102 and expose the shaped charge 102 to the wellbore.

As another example, an embodiment of the overmold 106 may reduce, or eliminate, stand-off concerns and enable the liner 101 the necessary space to form the jet without the jet contacting metal before hitting the target 120. This enables flexibility in terms of the geometries and shapes to be employed for the liner 101.

Further, an embodiment of the overmold 106 provide a containment function. Specifically, the overmold 106 may contain a shaped charge assembly 100 which may comprise the liner 101, charge 102, case 103, bulkhead 107, burst disk 121, detonator 104, and electrical wiring 111. The overmold 106 may also contain other devices such as tracers, data collection devices such as nanobots, and combustible materials such as zirconium.

An embodiment of the overmold 106 may act as a sealing mechanism. The sealing may seal off contaminant, such as water, from the shaped charge 102 as well as from electrical devices that are susceptible to damage by water.

As a final example, an embodiment of the overmold 106 may provide protection against energy generated by ignition or detonation of the charge 102. In particular, when the charge 102 is ignited and the explosion takes place inside the case 102, a large amount of energy may be generated that can expand the case 103 outward and towards the cartridge. In an embodiment, the overmold 106 may be configured, and have the material characteristics, to absorb some of the energy generated from the explosion.

D.6.1 Standoff

There are various standoff considerations that may apply in a downhole environment and process. These stand-off considerations may imply various concerns that may be resolved, in whole or in part, by an embodiment of the overmold 106.

In general, shaped charges are typically designed to operate at a specific optimal standoff distance. This distance is determined through extensive testing and engineering analysis to achieve the best penetration and jet formation characteristics. Deviating significantly from the optimal standoff distance may result in reduced performance.

The standoff distance can influence the penetration depth of the shaped charge 102, specifically, the jet produced by the shaped charge 102. In general, increasing the standoff distance tends to increase the penetration depth, up to a certain point. Beyond that point, increasing the standoff distance may cause the jet to disperse and experience a loss of effectiveness.

The standoff distance affects the formation and focusing of the shaped charge 102 jet. The jet is a high-velocity, high-pressure stream of molten metal that penetrates the target 120. The optimal standoff distance is chosen to achieve a well-formed and focused jet for maximum penetration.

The standoff distance requirements may vary depending on the type and properties of the target 120 material. Harder materials may require smaller standoff distances to achieve effective penetration, while softer materials may enable the use of larger standoff distances. In an embodiment, the jet produced by the overmolded shaped charge 102 first contacts the casing 103, but in an embodiment, the jet does not have to shoot through a layer of material in a gun tube/barrel, as would be the case with a standard shaped charge perforating gun which requires that the jet pass through the structure of the perforating gun before the jet hits the target 120. Thus, an embodiment may enable the shaped charge 102 to be moved relatively closer to the target 120, or further away from the target 120. Thus, in an embodiment, the location of the shaped charge 102 is not limited to one particular standoff distance, as is the case in a conventional perforating gun shooting a conventional shaped charge. Rather, an embodiment of the overmolded shaped charge 102 may be set, using variations in the overmold 106 geometry, at various standoff distances from the target 120, at least because the shaped charge 102 is overmolded and exposed, or may be, directly to the wellbore environment.

D.6.2 Example Materials for an Overmold

In an embodiment, an overmold 106 may comprise a polymer, plastic, or resin material that may be injected directly into a mold that houses the shaped charge 102 and other devices that may be contained within the shaped charge 102 or overmold 106. In an embodiment, the cartridge may comprise the mold for the overmold material. As noted elsewhere herein, the cartridge may comprise the cartridge wall 105, and the cartridge base 109. Some example over mold materials are discussed below.

One embodiment of an overmold 106 may comprise one or more materials from the resin family of amorphous thermoplastic polyetherimide (PEI) materials sold under the mark ULTEM™ 1000. This resin family is part of the polyetherimide (PEI) family of materials. Following are some example properties of this resin family.

1. Chemical Properties: ULTEM™ 1000 exhibits excellent chemical resistance to a variety of chemicals, including acids, bases, and hydrocarbons. It is also highly resistant to steam and hot water. Additionally, it has low moisture absorption.
2. Mechanical Properties: ULTEM™ 1000 has exceptional mechanical properties, including high tensile strength and modulus, as well as excellent resistance to impact and fatigue. It is also highly resistant to creep and stress relaxation, Furthermore, ULTEM™ 1000 has excellent stiffness and maintains its properties over a wide range of temperatures, from −40° C. to 170° C.
3. ULTEM™ 1000 Processing: ULTEM™ 1000 is a thermoplastic material that can be processed using a variety of methods, including injection molding, extrusion, and thermoforming. It can also be machined using standard machining techniques, such as milling, drilling, and turning. Additionally, it can be welded using a variety of methods, including ultrasonic welding, vibration welding, and hot plate welding.

In another example embodiment, an overmold 106 may be made of glass-filled PTFE. Polytetrafluoroethylene (PTFE) is a fluoropolymer, which may be sold under the mark TEFLON®, that has excellent chemical resistance, low friction coefficient, and non-stick properties. However, PTFE has limited strength and can deform under pressure or high-temperature conditions. To improve its strength and temperature resistance, glass fibers may be infused into the PTFE matrix, resulting in a composite material known as glass-filled PTFE. One example glass-filled PTFE combination may contain a high percentage of glass fibers, such as in the range of 25% to 30% by weight, with a specific glass fiber length and diameter that optimize the mechanical properties of the glass-filled PTFE. In an embodiment, the glass fibers provide a reinforcing effect that improves the tensile and compressive strength, stiffness, and resistance to deformation under pressure, of the glass-filled PTFE. Additionally, the glass fibers have a high thermal conductivity, which helps to dissipate heat from the glass-filled PTFE, improving its temperature resistance. Finally, the glass-filled PTFE also has a low coefficient of thermal expansion, making it less susceptible to dimensional changes under varying temperature conditions. Glass-filled PTFE includes excellent chemical resistance, non-stick properties, and a low friction coefficient. In an embodiment, the overmold 106 may comprise polycarbonate. An overmolding process that utilizes polycarbonate as one of, or the only, layer(s) of an overmold 106 may be the same as, or similar to, the overmolding process using PEI materials, and/or the overmolding process using glass-filled PTFE.

D.6.3 Example Overmolding Processes

Overmolding is a process that involves molding, in one embodiment, a thermoplastic material, such as a PEI material for example, over a component, or components, such as, but not limited to, an electronic component, shaped charge, detonator, bulkhead, and/or other devices. In one example embodiment, an overmold process may comprise the following four operations.

In one embodiment, the first operation of an overmolding process may comprise designing the mold for the overmolded part, taking into account the shape and size of the shaped charge 102, the desired thickness and shape of the overmold 106 to be created, and any other design requirements. Once the mold is designed, it is manufactured using, for example, precision machining techniques.

In an embodiment, the second operation comprises pretreatment of the shaped charge and other devices. For example, before overmolding, the shaped charge 102 must be properly prepared to ensure proper adhesion between the shaped charge 102 and the overmold 106 material(s). This preparation may involve cleaning, degreasing, or other surface preparation techniques, depending on the nature of the shaped charge and other devices.

In an embodiment, the third operation comprises forming the overmold 106 by injection molding. In one embodiment, this operation may comprise injection molding of ULTEM™ 1000 over the shaped charge 102 using the prepared mold. This process may comprise melting the thermoplastic material, injecting the melted thermoplastic material into the mold cavity, and then cooling and solidifying the thermoplastic material to form the overmolded shaped charge 102. In one embodiment, this process of injection molding may be repeated several times to achieve the desired thickness and shape of the overmold 106.

In an embodiment, the final operation of an overmolding process comprises post-molding processing. For example, once the overmolded shaped charge 102 is formed, any excess material may be removed using trimming or other post-molding processing techniques. The finished overmold 106 and/or other elements of the overmolded shaped charge 102 may also undergo additional finishing steps, such as polishing or painting, depending on the desired final appearance and functionality.

In an embodiment, an overmolding process may be performed using glass-filled PTFE. This overmolding process for glass-filled PTFE may comprise two, or more, separate injection molding operations. Except as noted below, the overmolding process for glass-filled PTFE may be similar, or identical, to the overmolding process for PEI materials such as ULTEM™1000. For example, during the overmolding process, the glass-filled PTFE is melted and injected into the mold over the shaped charge and other devices. The glass in the glass-filled PTFE material may improve the strength and durability of that material, relative to a PTFE material that does not include glass. The overmolding process can be used to create a product that is both strong and durable, with the ability to withstand a range of different conditions.

After the mold has been designed and produced for use in an overmolding process for glass-filled PTFE, and the shaped charge 102 prepared, a first overmold material, which may comprise any of the disclosed overmold material (s), is injected into the mold and flows around the electronics, shaped charge, detonator, bulkhead, and other devices, creating a solid overmold 106.

The mold is then cooled to solidify the first overmold material over the shaped charge 102. Next, the second overmold material, which may comprise glass-infused PTFE, is injected into the mold over the first material. The mold is then cooled to solidify the second material. Finally, the overmolded part is removed from the mold and any excess material is trimmed off or otherwise removed.

D.7 Bulkhead

Figure 2:
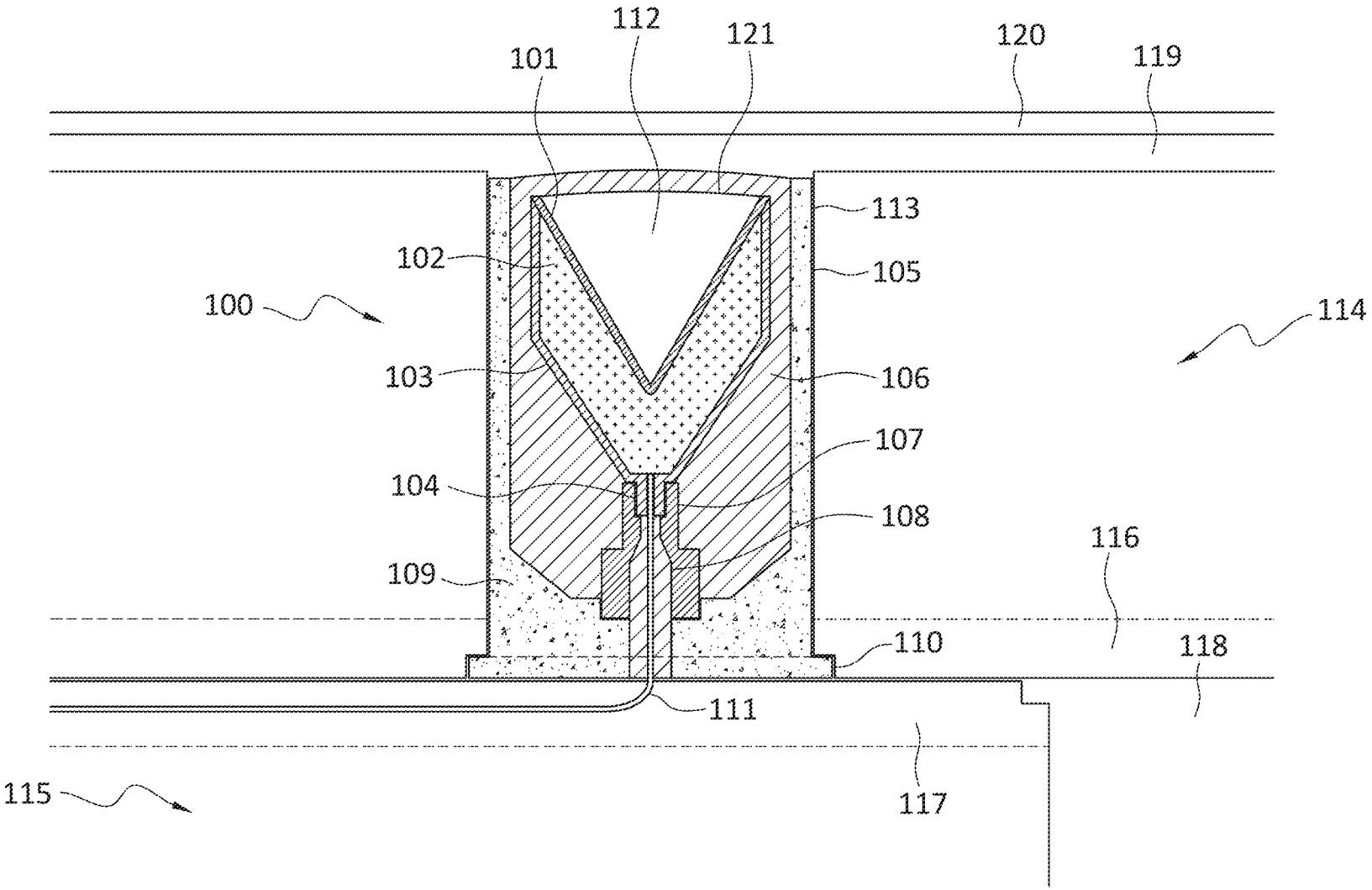
FIG. 2 discloses a cross section view of an overmolded shaped charge assembly including a cartridge that is chambered in an interlocking perforating gun, according to one embodiment.
Figure 3:
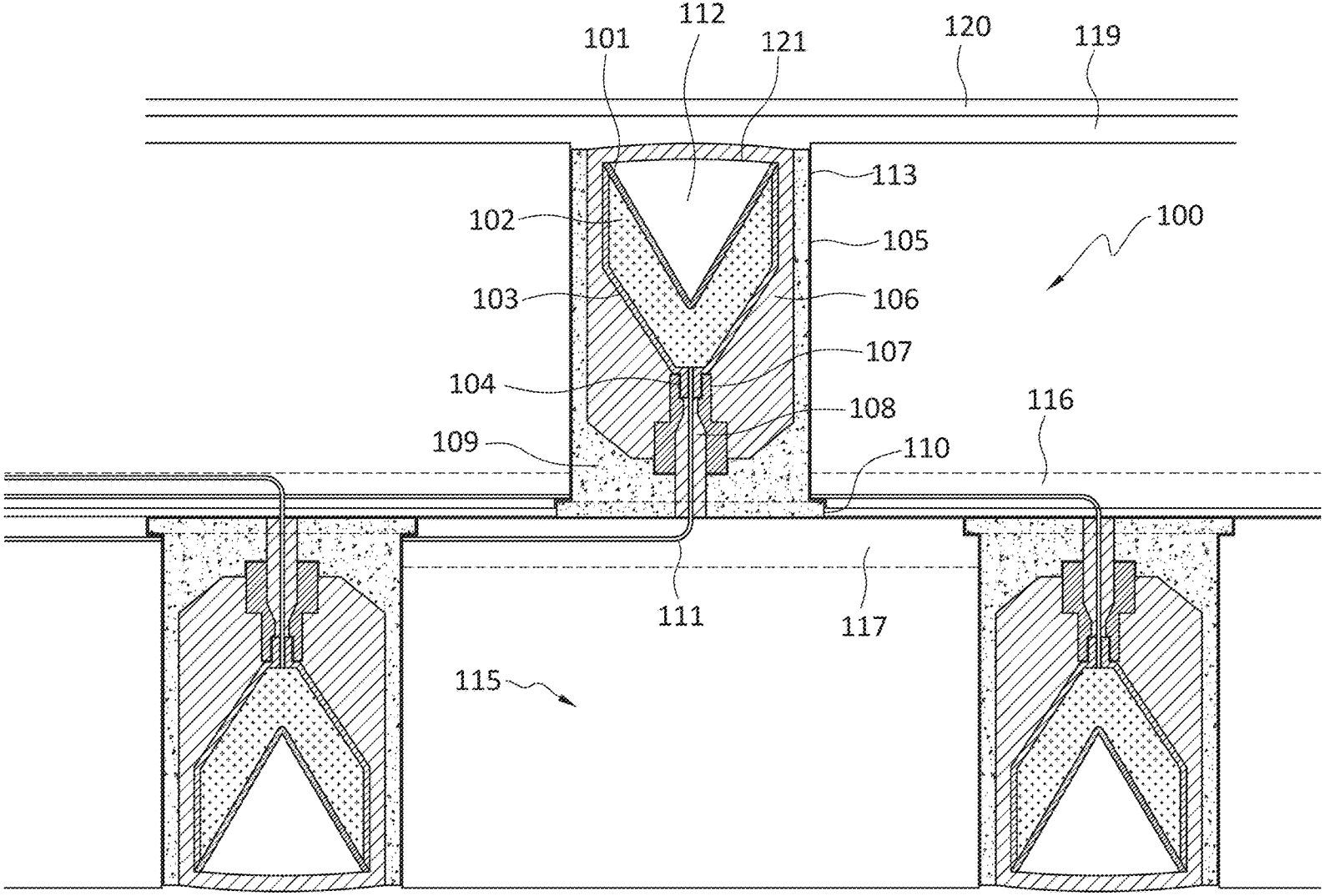
FIG. 3 discloses a cross section view of three overmolded shaped charges including a cartridges that are chambered in an interlocking perforating gun, according to one embodiment.

As shown in the example of FIGS. 1-3, an embodiment of a shaped charge assembly 100 may comprise a bulkhead 107 configured as a single individual component, or configured as part of the cartridge base 109. The bulkhead 107 may house the detonator 104 and detonator stem 108. The bulkhead 107 may also act as a foundation to ensure concentricity between the shaped charge 102 and the cartridge wall 105. In an embodiment, the bulkhead 107 may serve various purposes.

For example, a bulkhead 107 that is positioned below the shaped charge 102, and houses the detonator 104 and wiring 111 may provide a physical barrier between the shaped charge 102 and the rest of the cartridge and system. This arrangement may help to contain the explosion and prevent it from damaging other components or causing unintended collateral damage.

An embodiment of the bulkhead 107 may serve as a mounting point and/or housing for the detonator 104. By securing the detonator 104 in a fixed position below the shaped charge 102, the bulkhead 107 may help to ensure that the shockwave from the detonator 104 is directed into the shaped charge 102 in a consistent and controlled manner. The bulkhead 107 may, in an embodiment provide additional structural support to the shaped charge assembly 100 as a whole. By reinforcing the area below the shaped charge 102, the bulkhead 107 may help to prevent the cartridge from becoming deformed or damaged during use. In an embodiment, the bulkhead 107 may be configured as part of the cartridge base 109, such that the bulkhead 107 and the cartridge base 109 together form a single part, instead of two or more.

D.8 Detonator Stem

In an embodiment, a detonator stem 108, as disclosed in FIGS. 1-3 and 5 for example, may comprise an overmolded detonator 104, or detonation device, that may be hermetically sealed to the component that it encapsulates or sealed to the cartridge base 109 and/or bulkhead 107. A detonator stem 108 may comprise, but is not limited to, an overmolded component that houses the detonator 104 and wiring 111 and is encased by the bulkhead 107.

In one or more embodiments, an overmolded detonator stem 108 may encapsulate a variety of components. Such components may include, but are not limited to electric detonators; non-electric detonators, such as may be used in situations where electricity is not available or safe to use, that rely on a chemical reaction to initiate the detonation; shock tubes; safety fuses; pyrotechnic initiators; laser detonators; primers; and, det cord. Further details concerning each of these components is set forth below.

In general, shock tubes are thin tubes filled with a shock-sensitive explosive that are used to transmit a shock wave to the shaped charge. Shock tubes are often used in applications where electrical devices are not safe to use, such as in explosive environments. Safety fuses are simple detonation devices used in situations where no electrical or mechanical devices are available. A safety fuse is a length of cord filled with black powder that burns at a consistent rate, allowing for precise timing of the detonation. Pyrotechnic initiators may be small, self-contained devices that contain a pyrotechnic composition. They are often used in situations where a small and reliable detonation device is required. Laser detonators use a laser to initiate the detonation of the shaped charge 102. They may be used when extreme precision is required. Primers include mechanical or electrical ignition devices that comprise a small explosive charge that is used to initiate the detonation. Finally, det cord may comprise a flexible plastic tube filled with a high explosive material that is sensitive to shock, friction, and heat. When ignited, the det cord burns rapidly, generating a shock wave that is transmitted to the shaped charge 102, causing it to detonate.

D.9 Cartridge Base

A cartridge base 109 may, in one embodiment, may form the foundation of an entire overmolded shaped charge 102. The cartridge base 109 is located the rear, or very bottom, of the shaped charge assembly 100, that may be configured to interface with or contain a bulkhead 107, and may include the cartridge wall(s) 105 that contain the overmold 106 and shaped charge 102, and may include a rim that is configured as a chambering ledge for the shaped charge assembly 100 when the shaped charge assembly 100 is inserted into a barrel.

In an embodiment, the cartridge base 109 may perform one or more functions. For example, the cartridge base 109 may provide a surface for the wiring 111, detonator stem 108, and detonator 104. In particular, the base of the cartridge based 109 may comprise a small pocket or recess where the detonator 104, or other detonation devices, may be inserted, or the wiring 111 and detonator stem 108 may be housed.

As another example, an embodiment of the cartridge base 109 may server to the cartridge, that is, the shaped charge assembly 100 and 150: The cartridge base 109 is configured to create a gas-tight seal when it is inserted into a chamber of a perf gun or other device. This seal prevents gases from escaping when the shaped charge 102 is fired, which helps to increase the efficiency of the shot.

In an embodiment, the cartridge base 109 may also act as a secondary bulkhead. This configuration may increase the performance of the shaped charge 102 by creating more rigidity when the charge is ignited.

D.10 Cartridge Rim

In an embodiment, the cartridge rim 110 may be located at the very bottom of the shaped charge assembly 100 or 150, below the cartridge base 109, and may act as a landing edge for the shaped charge assembly 100 or 150 to be chambered into a barrel for use. The cartridge rim 110 may be integral with the cartridge base 109 and may enable, for example, extraction of the shaped charge assembly 100 or 150 from the barrel after firing.

In more detail, after the shaped charge 102 is fired, the spent shaped charge assembly 100 or 150 must be extracted from the chamber, or barrel, before another shaped charge assembly can be loaded. The cartridge rim 110 is configured and arranged to provide a protruding element for an extractor to grip, so that the extractor can remove the spent shaped charge assembly from the chamber, or barrel. Further, when loading the shaped charge assembly into a gun barrel, the cartridge rim 110 may act as a guide and stopping mechanism when the shaped charge assembly is loaded into the barrel.

D.11 Wiring

In an embodiment, the wiring 111, see FIGS. 1-3 and 5, may comprise a wire and a ground wire harnessed together that are connected to the detonator 104 that is housed in, or located near, the shaped charge 102. The wiring 111 may communicate data, power, and commands, to/from the shaped charge 102, other devices that may be embedded, partially or completely, into the material of the overmold 106, and the detonator 104. Thus, in an embodiment, the wiring 111 may be used to carry a signal to the detonator, or other detonation device used to activate the explosive charge. The various devices to which the wiring 111 may connect include, but not limited to, a LIDAR component/system, temperature sensors, a voltage detector, a time-of-flight (TOF) sensor, acoustic microscopy sensor, ultrasonic phased array sensors, X-ray microcomputed tomography sensors, and acoustic emission sensors. As discussed below, these sensors may serve a variety of purposes and any of these sensors may reside partly or completely within an overmold 106. In an embodiment, a sensor may be positioned on a first layer of an overmold, and covered by a second layer of the overmold.

For example, a LIDAR, or other imaging device may be embedded in, or otherwise contained within, the overmold 106 for viewing the target 120 before the shaped charge 102 is fired. Imaging, such as LiDAR, may also be used to measure the distance to the target 120 and analyze the overall surface of the target 120. Temperature sensors may be positioned in the overmold 106 to record and monitor the overall temperature of the shaped charge 102. A voltage detection sensor may be used to ensure that a live circuit still exists with the shaped charge 102, after a different shaped charge 102 is fired. This detection device may ensure that the shaped charges 102 still have voltage, are live, and have survived the shock and vibration that may occur when one or more other shaped charges 102 in the system are fired. TOF sensors may use ultrasonic or acoustic waves to determine the distance to a target 120. Acoustic microscopy sensors may use ultrasound to create high-resolution images of materials, including those that are opaque or have multiple layers. This sensor may be used to analyze the target 120 and the materials, void spaces, or organic matter that may be behind the first layer of the target 120. Ultrasonic phased array sensors may comprise multiple ultrasonic transducers to steer and focus sound waves in specific directions, allowing for precise imaging of complex structures and materials in downhole locations. This sensor could be used to analyze the target 120 and the materials, void spaces, or organic matter that may be behind the first layer of the target 120. X-ray microcomputed tomography (micro-CT) sensors may use X-rays to create high-resolution 3D images of materials, including those with multiple layers and complex internal structures. Finally, acoustic emission sensors may detect high-frequency sound waves that are emitted from materials under stress or deformation.

D.12 Void Space

As shown, for example, in FIGS. 1-4, a void space 112 is the volume between the liner 101 and the burst disk 121. The void space 112 may enable flexibility in the overmolded shaped charge. A volume of the void space 112 may be increased, or decreased, as needed to accommodate different shaped charge 102 geometries and shapes and to ensure an appropriate stand-off distance between the liner 101 and the target 120. As well, the void space 112 may enable a jet to fully form before it contacts the burst disk 121. This void space 112 may help to ensure optimal performance of the jet.

D.13 Burst Disk

Figure 4:
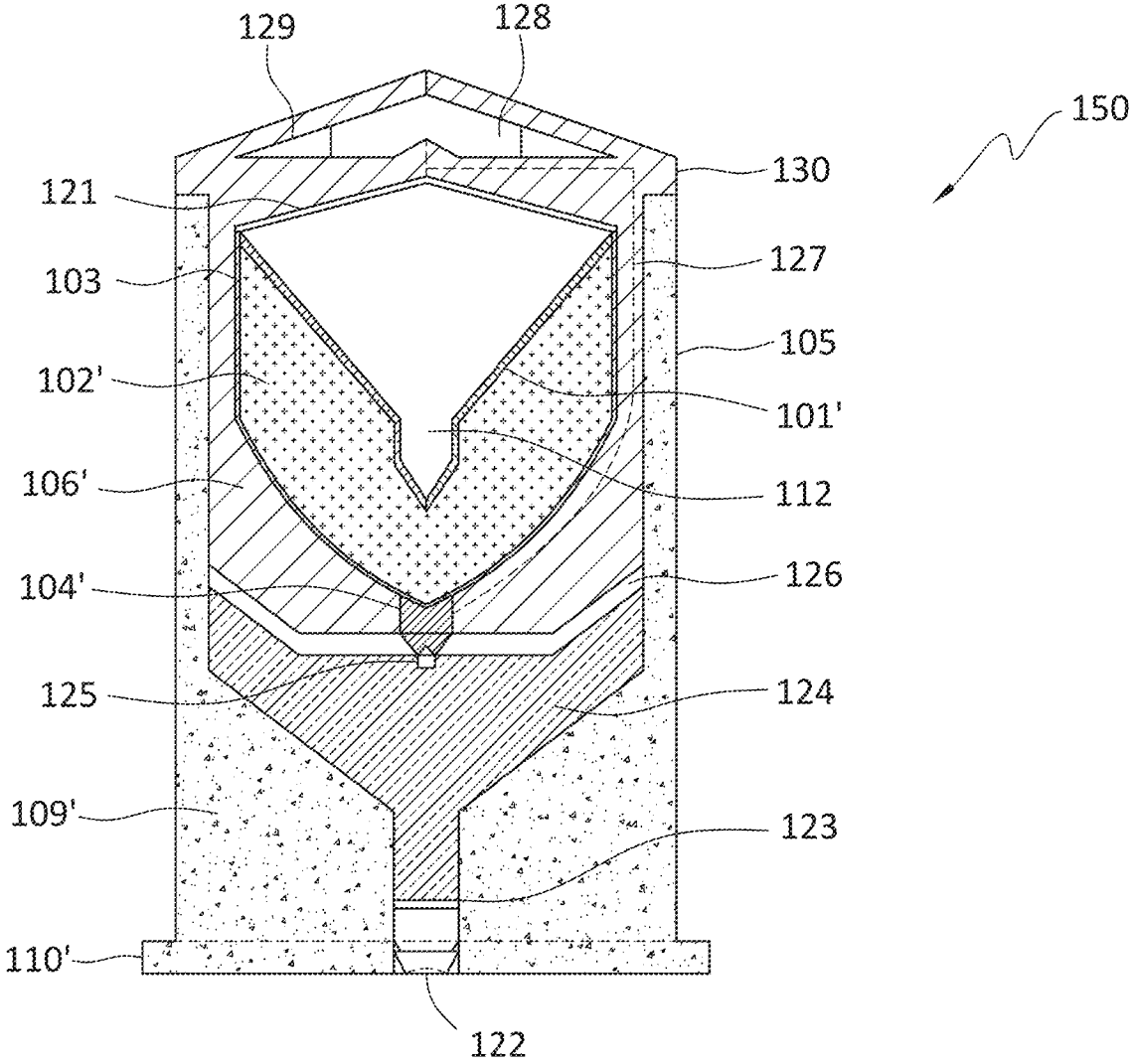
FIG. 4 discloses a cross section view of an overmolded propelled shaped charge (PTS assembly), according to one embodiment.

The burst disk may be a sacrificial element that comprises, for example, a dome-shaped configuration, as shown in FIGS. 1-3 for example. In the example of FIG. 4, the burst disk 121 has a conical configuration. In one embodiment, the burst disk 121 may comprise a thin, circular membrane with a high pressure side, located on the outside of the shaped charge assembly 100 for example, does not burst prematurely. A low-pressure side of the burst disk 121 may be positioned partly or completely in the void space 112, and may be configured such that when the jet impacts it, it bursts and allows the jet to continue traveling through the high-pressure side and towards the target 120. In an embodiment, the convex shape of an example burst disk 121 may, in operation, evenly distribute the pressure across the burst disk 121 surface, which helps to ensure a more uniform burst and minimize the risk of damage to the system. The shape and design of a burst disk can vary. Embodiments of a burst disk 121 may comprise and implement various useful features and functionalities.

For example, in high pressure environments, such as subsea, or subterranean/downhole oil and gas, external pressure would collapse the void space 112 without the burst disk 121 present. Thus, the burst disk 121 may preserve the integrity of the void space 121 from collapsing under extreme pressures. In an embodiment, a burst disk 121 may be installed into the overmolded shaped charge 102, above the liner 101, to accommodate adequate stand-off distance from the liner 101 to the target 120. In one embodiment, the burst disk 121 may be made of a material that may have the ability to turn into a jet itself when the liner 121 jet contacts it. This would increase the power potential and performance of the overmolded shaped charge.

Using a burst disk 121 that is installed above the shaped charge 102 may enhance the shaped charge 102 performance. For example, this configuration may enable the burst disk 121 to become a jet of molten metal itself and create a larger hole diameter than the hole created by the jet produced by the liner 121 of the shaped charge 102. As another example, the burst disk 121 may turn into a jet itself and create a hole geometry that may allow a standard cone shaped liner 101 to create a hole that may or may not be a circle or perfectly round, but an elliptical, square, or triangular shaped hole in the target 120.

Various materials may be used for the production of a burst disk 121. Such materials may include, but are not limited to, copper, titanium, ceramic, composite, aluminum, tungsten, copper-nickel, copper-zinc, copper-lead, copper magnesium, and zirconium, and combinations and alloys of any of these.

D.14 Barrel

The example barrel 113 disclosed in FIG. 2 may be defined by, or integral with, a perf gun, one example of which is the IPG disclosed herein, and may be configured to guide the cartridge walls 105 and chamber the shaped charge assembly by enabling the cartridge rim 110 to land at the bottom of the barrel 113. The length and diameter of the barrel 113 may vary depending on the size and shape of the shaped charge assembly that houses the overmolded shaped charge 102. Example materials that may be used to construct a barrel 113 include, but are not limited to, 4330, 4340, titanium, the nickel-chromium-based superalloys sold under the INCONEL® mark, nickel based alloys, and alloys containing molybdenum and or vanadium.

In an embodiment, a barrel 113 may perform various functions. Such functions include, for example, enclosing the cartridge walls 105, guiding the shaped charge assembly, ensuring survivability of the gun system after the overmolded shaped charge 102 is fired, acting as a secondary pressure chamber that ensures efficient performance of the overmolded shaped charge 102 by acting as a rigid member to focus the jet and energy in the direction of the explosion, chambering the overmolded shaped charge assembly, and stabilizing the overmolded shaped charge assembly when the shaped charge 102 is fired or ignited.

D.15 IPG (Interlocking Perforating Gun) Body 1

According to one example embodiment, an Interlocking Perforating Gun (IPG) Body 1 (114), disclosed in FIG. 2, may include a gun body that radially interlocks with IPG Body 2 (115) and may contain a wire tray, barrels, and overmolded shaped charges. IPG Body 1 (114) may comprise multiple barrels and multiple overmolded shaped charges 102.

D.16 IPG Body 2

In an embodiment, IPG Body 2 (115), disclosed in FIG. 2, may comprise a gun body that radially interlocks with IPG Body 1 (114) and may contain a wire tray, barrels, and overmolded shaped charges. IPG Body 2 (115) may comprise multiple barrels and multiple overmolded shaped charges.

D.17 IPG Body 1 Wire Tray

In an embodiment, the wire tray 116 in IPG Body 1 (114), as shown in FIG. 2, may comprise multiple wires that may run to the overmolded shaped charges 102 and other devices that may be overmolded into the overmold 106 material. The wire tray 116 may also comprise power and command wires that may connect to other components in the system such as data collection systems, other tools, or devices that require electrical command signals and power.

D.18 IPG Body 2 Wire Tray

The wire tray 117 in IPG Body 2 (115), as shown in FIG. 2, may comprise multiple wires that may connect to the overmolded shaped charges 102 and other devices that may be overmolded into the overmold 106 material. The wire tray 117 may also comprise power and command wires that may connect to other components in the system such as data collection systems, other tools, or devices that require electrical command signals and power.

D.19 IPG Body 2 Barrel

IPG Body 2 (115) barrel 118 in FIG. 2 is shown as an empty barrel. It is illustrated in the Figure to show what an empty barrel IPG Body 2 (115) barrel 118 may look like in one embodiment.

D.20 Fluid

As shown in the example of FIG. 2, an embodiment may be employed in a downhole, or other, environment. Such an environment may include fluids 119 such as, but not limited to, water and other liquids, air, other gases, hydrocarbons, particulates and other solid matter.

D.21 Target

In an embodiment, a target 120 may comprise a steel pipe or casing. However, the scope of this disclosure is not limited to targets 120 that comprise pipe or casing.

E. ASPECTS OF FURTHER EMBODIMENTS

As noted earlier, FIG. 4 discloses an example shaped charge assembly 150 that differs in some respects from the shaped charge assembly 100. Examples of such differences are discussed below.

In an embodiment, the shaped charge assembly 150 comprises an overmolded shaped charge 102 that can be propelled, by firing out of a cartridge and or barrel. One embodiment of the shaped charge assembly 150 comprises a shaped charge 102, fuses, overmold 106 material, combustible materials, a shield, a cartridge, and mechanical or electrical ignition devices and or detonators 104. The shaped charge assembly 150 may be shot out of a barrel at a target 120 and on impact, ignite the shaped charge 102 located inside the shaped charge assembly 150, creating a jet out of a liner 101, and penetrating the target 120 that it impacted.

E.1 Liner

In the particular embodiment of FIG. 4, the embodiment of the liner 101' may be configured to create a deep or shallow penetration through the target 120. The liner 101' may also be configured such that it may create large or small holes comprising multiple geometries in the target 120. The liner 101' of FIG. 4 may comprise multiple liners formed into one individual liner, that is, as the liner 101' shown in FIG. 4. The small cone located at the base of the liner 101 and just above the detonator 104 may form the first jet, followed by the secondary jet that may be created when the jet passes the liner 101' area that goes straight to the case 103. This specific jet shape may create a consistent hole shape and consistent penetration depth, due to the ability to increase stand-off distance between the first formed jet and the burst disk 121.

E.2 Detonator

In an embodiment, the detonator 104' disclosed in FIG. 4 may be the same as the detonator 104 disclosed in FIGS. 1-3, with the following possible exception. The detonator 101' may be detonated by a timed fuse and or impact fuse. The detonator 101' may be a hybrid electromechanical detonator that can be detonated both electrically and mechanically.

E.3 Cartridge Wall

In an embodiment, the cartridge wall 106' disclosed in FIG. 4 may be the same as the cartridge wall 106 disclosed in FIGS. 1-3, with the following possible exceptions. In one or more embodiments, the cartridge wall 106' in the case of a PTS survives and may be reloaded with another overmolded shaped charge 102 and propellant, or be discarded and discharged from a firing system for an additional loaded cartridge to take its place in a barrel. Further, when the propellant 124 is ignited by a primer 122, see FIG. 4, a peak pressure of up to 80,000 psi may be generated inside of the shaped charge assembly 150. That pressure will release the overmolded shaped charge 102' and propel it forward at a high velocity.

The cartridge walls 105' disclosed in FIG. 4 may be comprised of a variety of different materials. Some examples of such materials include, but are not limited to: PEEK (polyetheretherketone); PPS (polyphenylene sulfide): PEI (Polyetherimide): PSU (polysulfone); and PPA (polyphthalamide).

E.4 Overmold Materials

In an embodiment, the overmold 106' disclosed in FIG. 4 may be similar or identical to the overmold 106 of FIGS. 1-3, with the following possible exceptions. The overmold 106' material may contain any one or more of devices that may comprise and be used as shrapnel, incendiary materials and devices, and illumination materials and devices.

E.5 Cartridge Base

In an embodiment, the cartridge base 109' disclosed in FIG. 4 may be similar or identical to the cartridge base 109 of FIGS. 1-3, with the following possible exceptions. The cartridge base 109' may include or contain any one or more of a percussion, mechanical, or electrical primer 122, one or more propellants 124, and a booster 123.

E.6 Cartridge Rim

In an embodiment, the cartridge rim 110' disclosed in FIG. 4 may be similar or identical to the cartridge rim 110' of FIGS. 1-3, with the following possible exceptions. The cartridge rim 110' may comprise a primer 122 positioned at its center, as discussed below.

E.7 Primer

As disclosed in the example of FIG. 4, the shaped charge assembly 150 may comprise a primer 122 that is used to ignite the propellant 124 that propels the overmolded shaped charge 102 out of the shaped charge assembly 150.

Example primers 122 that may be employed in the example shaped charge assembly 150 include, but are not limited to, Percussion Primers, centerfire primers, boxer primers, berdan primers, and electric primers. Percussion primers may comprise a small metal cup that contains a volatile compound such as fulminate of mercury. When struck by a firing pin or hammer, the compound ignites and ignites the propellant. Rimfire primers are a type of percussion primer that are used in rimfire cartridges. In these primers, the volatile compound is contained in the rim of the cartridge case. When the firing pin strikes the rim, the compound ignites and ignites the propellant in the cartridge. Centerfire primers consist of a volatile compound that is contained in the center of the cartridge case. Boxer primers are a type of centerfire primer that have a single flash hole in the center of the primer cup. Berdan primers have multiple flash holes around the primer cup. Electric primers use an electrical charge to ignite a small amount of explosive material.

E.8 Booster

The example shaped charge assembly 150 may comprise a booster 123. The booster 123 may comprise a combustible material that is the first material ignited by the primer 122. The booster 123, once ignited by the primer 122, will create additional energy that may be transferred into the propellant 124, igniting it at a faster rate, and then propelling the overmolded shaped charge 102. A variety of different materials may be used to produce the booster 123 including, for example, lead styphnate, tetrazene, barium nitrate, lead azide, and mercury fulminate. Lead styphnate is a highly sensitive, low-temperature explosive that can be easily initiated by impact or heat. Tetrazene is a high-performance booster material. Barium nitrate is low-sensitivity booster material. Lead azide is a highly sensitive booster material. Mercury fulminate is a low-sensitivity booster material.

E.9 Propellant

The example shaped charge assembly 150 disclosed in FIG. 4 may comprise one or more propellants 124. A propellant 124 may have a powder or pellet/consolidated form. The propellant 124, when ignited, is used to propel the overmolded shaped charge 102 out of the shaped charge assembly 150 and towards a target. A propellant 124 according to one embodiment may comprise any combination of materials including any one or more of nitrocellulose, nitroglycerin, ammonium nitrate, aluminum powder, potassium nitrate, charcoal, and magnesium. Nitrocellulose is a highly flammable compound made by nitrating cellulose fibers. Nitroglycerin is a highly explosive liquid compound that is a component of high-powered explosives. Ammonium nitrate may be used as an oxidizer. Aluminum powder may be used to increase energy density. Potassium nitrate may be used as an oxidizer. Charcoal may be used as a binding material. Magnesium may be used to increase the burn rate.

E.10 Timed Fuse

The example shaped charge assembly 150 disclosed in FIG. 4 may comprise a timed fuse 125. In an embodiment, the timed fuse 125 may be set, or the timer may start, when the propellant 124 is ignited. Ignition of the propellant 124 may cause the propellant 124 to move, and this movement may start the timed fuse 125. The timed fuse 125 may be located at the bottom of the overmolded shaped charge 102. The ignition of the propellant 124 itself will create the compression and energy to start the timed fuse 125. In an embodiment, the timed fuse 125 serves as a secondary ignition device if the impact fuse does not set off the detonator 104. The set times of the timed fuse 125 may be customizable to accommodate the particular use case for the shaped charge assembly 125, and the target distance, or standoff.

Embodiments may employ various different types of timed fuses 125. Examples of timed fuses 125 that may be employed in an embodiment include, but are not limited to, a time pencil fuse, time light fuse, electric time fuse, mechanical time fuse, and a percussion fuse. A time pencil fuse is a type of timed fuse that uses a spring-loaded mechanism to control the burn rate. As the fuse burns, it pulls a spring-loaded striker mechanism back, and when the striker is released, it sets off the detonator. A time light fuse is a type of timed fuse that uses a chemical delay element to control the burn rate. When the fuse is lit, a chemical reaction occurs that produces a flash of light. The time it takes for the flash to occur is used to time the detonation. An electric time fuse is a type of timed fuse that uses an electrical current to trigger the detonator. The current is typically controlled by a timer or other electronic device. A mechanical time fuse is a type of timed fuse that uses a mechanical device, such as a clockwork mechanism, to control the burn rate. When the mechanism runs out of energy, it triggers the detonator. A percussion fuse is activated by a sharp impact and is designed to ignite the explosive charge upon impact. The percussion fuse may ignite the charge within microseconds of the propellant 124 ignition.

E.11 Shield

The example shaped charge assembly 150 disclosed in FIG. 4 may comprise a shield 126. In one embodiment, the shield 126 may comprise an alloy or metal material and may be located at the bottom of the overmold 106' but molded within the overmold 106'. The example shield 126 may provide various functionalities. For example, the shield 126 may comprise a boat tail configuration that may help to improve the aerodynamics of the overmolded shaped charge 102' in flight. As another example, the shield 126 may serve as a rigid driving device that is able to withstand the pressure and expansion of gas when the propellant 124 is ignited.

E.12 Impact Command Wire

The example shaped charge assembly 150 disclosed in FIG. 4 may comprise an impact command wire (ICW) 127. In an embodiment, the ICW 127 carries a frequency to the detonator when the impact fuse receives impact that is equivalent to the forces that occur on the PTS when fired at a high velocity. That frequency to the detonator is adequate to set off the electromechanical detonator and ignite the charge. In an embodiment, the ICW 127 may be embedded in the overmold 106' and may be routed down the side between the case 103 and the cartridge walls 105.

E.13 Impact Fuse

The example shaped charge assembly 150 disclosed in FIG. 4 may comprise an impact fuse 128. In an embodiment, the impact fuse 128, upon being impacted by a force of a specified magnitude, sends a signal through the ICW 127 to the detonator 104' to ignite the shaped charge 102'. Example impact fuses that may be employed in an embodiment include, but are not limited to, percussion fuses, quick fuses, base detonating fuses, point detonating fuses, and proximity fuses. A percussion fuse is activated by a sharp impact and is designed to ignite the explosive charge upon impact. A quick fuse is also activated by a sharp impact but is designed to ignite the explosive charge more quickly than a simple percussion fuse. A base detonating fuse is designed to detonate the explosive charge at the base of a projectile upon impact. A point detonating fuse is designed to detonate the explosive charge upon impact with a hard surface. A proximity fuse is designed to detonate the explosive charge when it comes within a certain distance of a target.

E.14 Combustible Material

The example shaped charge assembly 150 disclosed in FIG. 4 may comprise a combustible material 129. In one embodiment, the combustible material 129 may surround the impact fuse 128 and be in the shape of a disk, or washer. On impact, the combustible material 129 may produce various effects. For example, the combustible material 129 may act as an incendiary device and ignite the target. As another example, the combustible material 129 may act as an incendiary device and burn through the target. As a final example, the combustible material 129 may act as an incendiary device and burn up the impact fuse 128 before the jet reaches it.

E.15 Ogive

The example shaped charge assembly 150 disclosed in FIG. 4 may comprise an ogive 130 shape or configuration at or near the top of the shaped charge assembly 150. In an embodiment, the ogive 130 may be a curved, tapered shape that is configured to improve the aerodynamic properties of the shaped charge assembly 150, reducing air resistance and improving accuracy and range. In one embodiment, the ogive 130 shape may be a smooth, continuous curve that gradually tapers to a point.

F. EXAMPLE SHAPED CHARGE AFTER FIRING

Figure 5:
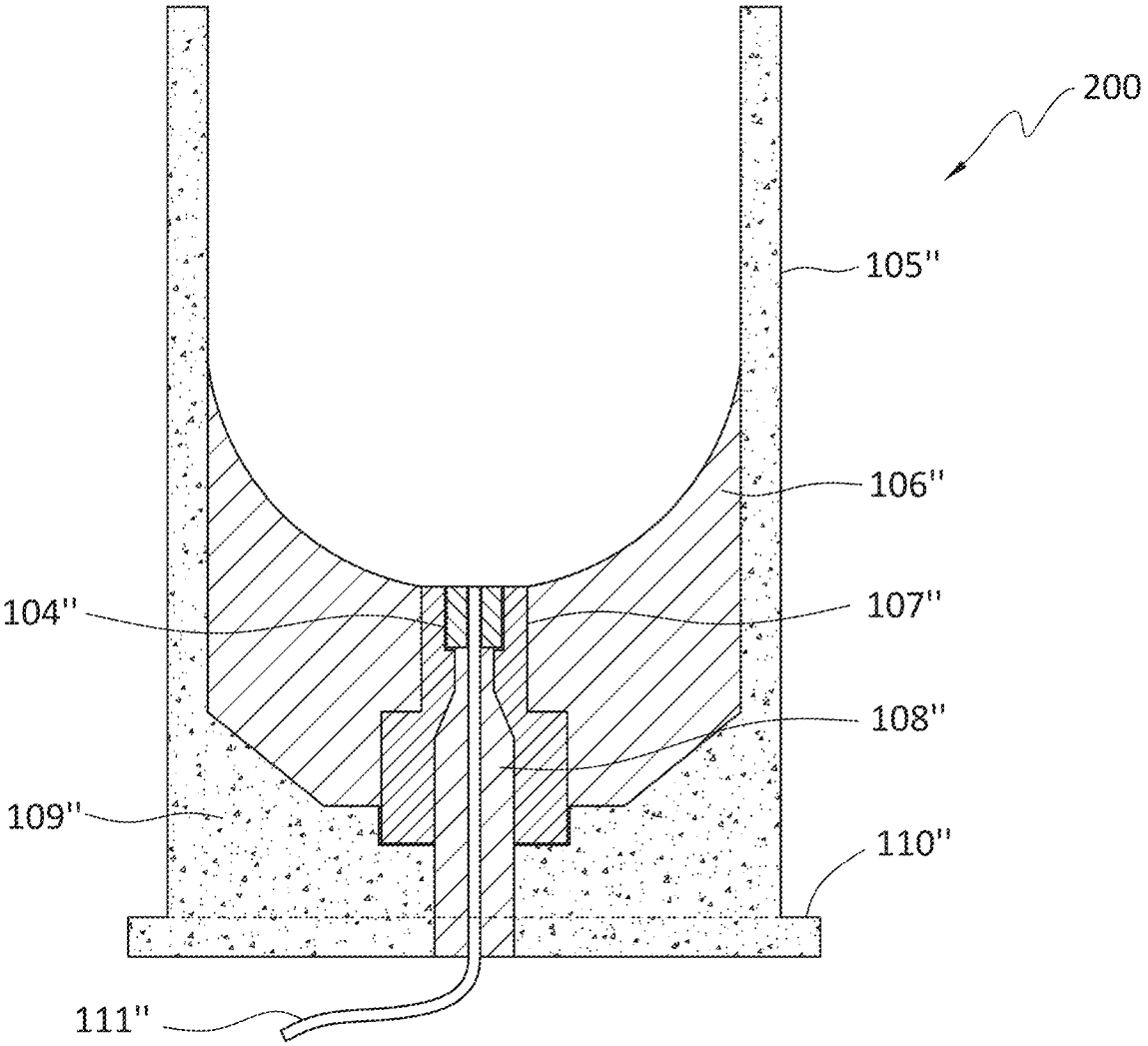
FIG. 5 discloses a cross section view of an overmolded shaped charge that has been fired or detonated, according to one embodiment.

With attention now to the example of FIG. 5, there is disclosed a fired shaped charge assembly 200 that once housed an overmolded shaped charge. The overmolded shaped charge has been fired and FIG. 5 may represent what a shaped charge assembly may look like after an overmolded shaped charge has been fired from it. The fired shaped charge assembly 200 may retain one or more of the following components after firing: detonator 104", cartridge wall 105", overmold 106", bulkhead 107", detonator stem 108", cartridge base 109", cartridge rim 110", and wiring 111". In an embodiment, any of the aforementioned components may be similar, or identical, to their respective counterparts in the examples of FIGS. 1-4.

G. APPENDIX

The Appendix hereto, incorporated in this disclosure in its entirety by this reference, comprises, at pages 1-5, photographs of example shaped charges, according to various embodiments, and their effects when employed, according to one or more embodiments. Pages 6-7 of the Appendix depict conventional perf guns.

The described embodiments are to be considered in all respects only as illustrative and not restrictive. All changes which come within the meaning and range of equivalency of the claims are to be embraced within their scope.

What is claimed is:

1. An apparatus comprising:

a liner;

a case;

a shaped charge positioned between the liner and the case;

a detonator located below one end of the case; and an overmold surrounding a portion of the shaped charge, and the overmold, the detonator, the shaped charge, the case, and the liner, are coaxial with each other.

2. The apparatus as recited in claim 1, where the overmold comprises two layers, and a portion of a component is embedded between the two layers.

3. The apparatus as recited in claim 2, wherein the component comprises an electrical device and/or an electronic device.

4. The apparatus as recited in claim 1, wherein the detonator is completely disposed within an interior of the overmold.

5. The apparatus as recited in claim 1, further comprising a cartridge within which a portion of the overmold is disposed, and the cartridge is configured and arranged to be removably received within a barrel of a perforation gun.

6. The apparatus as recited in claim 1, further comprising a burst disk with which the overmold cooperates to hermetically seal the shaped charge from an external environment.

7. The apparatus as recited in claim 1, wherein the overmold comprises on or more layers, and one of the layers comprises a polymer, plastic, resin materials, glass, composite, or metal material.

8. The apparatus as recited in claim 1, wherein the apparatus is configured to be placed directly into a barrel for firing, and the apparatus comprises a rim configured to be engaged by an extractor for removal of the apparatus from the barrel after the apparatus has been fired.

9. The apparatus as recited in claim 1, wherein the overmold defines an interior, and a portion of the interior of the overmold has a tapered configuration that surrounds and contacts a tapered bottom portion of the case.

10. The apparatus as recited in claim 1, wherein the apparatus comprises a propellant, a primer, and a fuse, that are all positioned within a cartridge wall below the shaped charge and the overmold, and the cartridge wall has a hollow cylindrical configuration.

11. An apparatus comprising:

a perforation gun including a reusable gun body that comprises a barrel and a hole that is aligned with the barrel, and the hole is open to an external environment; and a shaped charge assembly configured to be removably received in the barrel, and the shaped charge assembly comprises a shaped charge at least partly contained by an overmold comprising one or more layers, and the overmold defines an interior, and a portion of the interior of the overmold has a tapered configuration that surrounds and contacts a tapered portion of the bottom of the case.

12. The apparatus as recited in claim 1, further comprising a bulkhead within which respective portions of the detonator and a detonator stem are received, and the bulkhead is at least partly disposed within, and directly contacts, the overmold.

13. The apparatus as recited in claim 12, further comprising an electrical conductor that passes through the detonator and the detonator stem, and contacts the shaped charge.

14. The apparatus as recited in claim 12, wherein the detonator stem extends from the detonator to a bottom of a cartridge in which the overmold is received.

15. The apparatus as recited in claim 11, wherein the shaped charge assembly comprises a propellant, a primer, and a fuse, that are all positioned within a cartridge wall below the shaped charge and the overmold, and the cartridge wall has a hollow cylindrical configuration.

16. The apparatus as recited in claim 11, wherein the shaped charge is contained in an enclosure that is sealed at one end by a burst disk.

17. The apparatus as recited in claim 1, wherein the overmold is non-metallic.

18. The apparatus as recited in claim 11, wherein further comprising a cartridge configured to hold the overmold, but no additional instances of the overmold.

19. The apparatus as recited in claim 11, wherein the shaped charge assembly comprises an impact fuse.

20. An apparatus with a post-firing configuration, comprising:

a cartridge that is open at one end;

a partial overmold disposed within the cartridge so that a curved upper surface of the overmold is exposed to an external environment;

a bulkhead disposed within the overmold and extending upward to the upper surface of the overmold;

a detonator disposed within the bulkhead and extending upward to the upper surface of the overmold; and a detonator stem disposed within the bulkhead and extending up to the detonator.

* * * * *